US011577130B2

(12) United States Patent
Hoffman et al.

(10) Patent No.: US 11,577,130 B2
(45) **Date of Patent: *Feb. 14, 2023**

(54) GOLF CLUB HEAD

(71) Applicant: Taylor Made Golf Company, Inc, Carlsbad, CA (US)

(72) Inventors: Joseph H. Hoffman, Carlsbad, CA (US); Chris Rollins, Carlsbad, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/403,516

(22) Filed: Aug. 16, 2021

(65) Prior Publication Data

US 2022/0032136 A1 Feb. 3, 2022

Related U.S. Application Data

(63) Continuation of application No. 16/990,666, filed on Aug. 11, 2020, now Pat. No. 11,117,027, which is a continuation of application No. 16/554,420, filed on Aug. 28, 2019, now Pat. No. 10,773,135.

(51) Int. Cl.
*A63B 53/04* (2015.01)
*A63B 53/02* (2015.01)

(52) U.S. Cl.
CPC ..... *A63B 53/0466* (2013.01); *A63B 53/02* (2013.01); *A63B 53/021* (2020.08); *A63B 53/04* (2013.01); *A63B 53/0408* (2020.08); *A63B 53/0412* (2020.08); *A63B 53/0433* (2020.08); *A63B 2053/0491* (2013.01); *A63B 2209/00* (2013.01)

(58) Field of Classification Search
CPC ..... A63B 53/0466; A63B 53/0412; A63B 53/021; A63B 53/0433; A63B 53/0408; A63B 53/02; A63B 53/04; A63B 2053/0491; A63B 2209/00
See application file for complete search history.

(56) References Cited

U.S. PATENT DOCUMENTS

| | | | |
|---|---|---|---|
| 6,096,897 | A | 8/2000 | Luengo et al. |
| 6,244,976 | B1 | 6/2001 | Murphy et al. |
| 6,353,786 | B1 | 3/2002 | Yamada et al. |
| 6,773,360 | B2 | 8/2004 | Willett et al. |
| 6,800,038 | B2 | 10/2004 | Willett et al. |
| 6,824,475 | B2 | 11/2004 | Burnett et al. |

(Continued)

OTHER PUBLICATIONS https://pluggedingolf.com/ping-rapture-fairway-wood-review/, access May 15, 2020.

(Continued)

*Primary Examiner* — William M Pierce
(74) *Attorney, Agent, or Firm* — Kunzler Bean & Adamson

(57) ABSTRACT

Disclosed herein is a golf club head that comprises a body. The body comprises a sole portion, a crown portion, a skirt portion, and a face portion, positioned at a forward region of the golf club head, opposite a rearward region of the golf club head, and extending from a toe region to a heel region of the golf club head. At least a portion of the body is made of a titanium alloy. The golf club head also comprises a large weight, coupled to the sole portion of the body and made of a steel alloy. A mass of the large weight is at least 40% of a mass of the portion of the body made of the titanium alloy. A total mass of the large weight and the portion of the body made of the titanium alloy is at least 210 grams.

21 Claims, 10 Drawing Sheets

(56) References Cited

U.S. PATENT DOCUMENTS

| | | | |
|---|---|---|---|
| 6,997,820 | B2 | 2/2006 | Willett et al. |
| 7,140,974 | B2 | 11/2006 | Chao et al. |
| 7,166,040 | B2 | 1/2007 | Hoffman et al. |
| 7,186,190 | B1 | 3/2007 | Beach et al. |
| 7,223,180 | B2 | 5/2007 | Willett et al. |
| 7,267,620 | B2 | 9/2007 | Chao et al. |
| 7,407,447 | B2 | 8/2008 | Beach et al. |
| 7,410,425 | B2 | 8/2008 | Willett et al. |
| 7,410,426 | B2 | 8/2008 | Willett et al. |
| 7,419,441 | B2 | 9/2008 | Hoffman et al. |
| 7,448,963 | B2 | 11/2008 | Beach et al. |
| 7,452,285 | B2 | 11/2008 | Chao et al. |
| 7,530,904 | B2 | 5/2009 | Beach et al. |
| 7,540,811 | B2 | 6/2009 | Beach et al. |
| 7,568,985 | B2 | 8/2009 | Beach et al. |
| 7,578,753 | B2 | 8/2009 | Beach et al. |
| 7,591,738 | B2 | 9/2009 | Beach et al. |
| 7,621,823 | B2 | 11/2009 | Beach et al. |
| 7,628,707 | B2 | 12/2009 | Beach et al. |
| 7,628,712 | B2 | 12/2009 | Chao et al. |
| 7,632,194 | B2 | 12/2009 | Beach et al. |
| 7,713,142 | B2 | 5/2010 | Hoffman et al. |
| 7,717,804 | B2 | 5/2010 | Beach et al. |
| 7,717,805 | B2 | 5/2010 | Beach et al. |
| 7,744,484 | B1 | 6/2010 | Chao |
| RE41,577 | E | 8/2010 | McLean et al. |
| 7,775,905 | B2 | 8/2010 | Beach et al. |
| 7,846,041 | B2 | 12/2010 | Beach et al. |
| 7,874,936 | B2 | 1/2011 | Chao |
| 7,874,937 | B2 | 1/2011 | Chao |
| 7,874,938 | B2 | 1/2011 | Chao |
| 7,963,861 | B2 | 6/2011 | Beach et al. |
| RE42,544 | E | 7/2011 | Chao et al. |
| 7,985,146 | B2 | 7/2011 | Lin et al. |
| 8,025,587 | B2 | 9/2011 | Beach et al. |
| 8,235,831 | B2 | 8/2012 | Beach et al. |
| 8,235,844 | B2 | 8/2012 | Albertsen et al. |
| 8,241,143 | B2 | 8/2012 | Albertsen et al. |
| 8,241,144 | B2 | 8/2012 | Albertsen et al. |
| 8,337,319 | B2 | 12/2012 | Sargent et al. |
| 8,398,503 | B2 | 3/2013 | Beach et al. |
| 8,444,505 | B2 | 5/2013 | Beach et al. |
| 8,496,541 | B2 | 7/2013 | Beach et al. |
| 8,628,434 | B2 | 1/2014 | Chao |
| 8,684,863 | B2 | 4/2014 | Bezilla et al. |
| 8,734,271 | B2 | 5/2014 | Beach et al. |
| 8,747,253 | B2 | 6/2014 | Stites |
| 8,758,153 | B2 | 6/2014 | Sargent et al. |
| 8,784,232 | B2 | 7/2014 | Jertson et al. |
| 8,858,359 | B2 | 10/2014 | Willett et al. |
| 8,870,678 | B2 | 10/2014 | Beach et al. |
| 8,870,679 | B2 | 10/2014 | Oldknow |
| 8,876,622 | B2 | 11/2014 | Beach et al. |
| 8,888,607 | B2 | 11/2014 | Harbert et al. |
| 8,900,069 | B2 | 12/2014 | Beach et al. |
| 9,033,813 | B2 | 5/2015 | Oldknow et al. |
| 9,033,821 | B2 | 5/2015 | Beach et al. |
| 9,174,096 | B2 | 11/2015 | Sargent et al. |
| 9,205,311 | B2 | 12/2015 | Stoke |
| 9,216,333 | B2 | 12/2015 | Bezilla et al. |
| 9,220,953 | B2 | 12/2015 | Beach et al. |
| 9,259,625 | B2 | 2/2016 | Sargent et al. |
| 9,415,280 | B2 | 8/2016 | Stokke et al. |
| 9,504,884 | B2 | 11/2016 | Bennett et al. |
| 9,662,545 | B2 | 5/2017 | Beach et al. |
| 9,873,029 | B1 | 1/2018 | Sillies |
| 9,987,525 | B2 | 6/2018 | Stokke et al. |
| 10,046,212 | B2 | 8/2018 | Sargent et al. |
| 10,188,915 | B1 | 1/2019 | Hoffman et al. |
| 10,369,430 | B2 | 8/2019 | Stokke et al. |
| 10,589,155 | B2 | 3/2020 | Hoffman et al. |
| 10,653,926 | B2 | 5/2020 | Story et al. |
| 10,773,135 | B1 | 9/2020 | Hoffman et al. |
| 2002/0055393 | A1 | 5/2002 | Reyes et al. |
| 2002/0183136 | A1 | 12/2002 | Helmstetter et al. |
| 2007/0049400 | A1 | 3/2007 | Imamoto et al. |
| 2008/0149267 | A1 | 6/2008 | Chao |
| 2009/0163289 | A1 | 6/2009 | Chao |
| 2012/0122601 | A1 | 5/2012 | Beach et al. |
| 2013/0090185 | A1 | 4/2013 | Boyd et al. |
| 2014/0248976 | A1 | 9/2014 | Stokke |
| 2014/0302946 | A1 | 10/2014 | Rae et al. |
| 2015/0297960 | A1 | 10/2015 | Goudarzi et al. |
| 2015/0321055 | A1 | 11/2015 | Golden et al. |
| 2018/0243622 | A1 | 8/2018 | Stokke et al. |
| 2019/0201754 | A1 | 7/2019 | Hoffman et al. |

OTHER PUBLICATIONS

Hopely, Martin, Adams Tight Lies 2 & Tight Lies Ti Fairway Review, Golfalot, Feb. 23, 2015, pp. 1-13, https://www.golfalot.com/equipment-reviews/adams-tight-lies-2-ti-fairway-review-3148.aspx, accessed May 15, 2020.

http://www.intheholegolf.com/AG15-TIGHTLIESTFW/Adams-Tight-Lies-Titanium-Fairway-Wood.html, accessed May 15, 2020.

Procedure for Measuring the Club Head Size of Wood Clubs, USGA and R&A Rules Limited, Nov. 21, 2003, pp. 1-6, https://www.usga.org/content/dam/usga/pdf/Equipment/TPX3003-procedure-for-measuring-the-club-head-size-of-wood-clubs.pdf, accessed May 15, 2020.

U.S. Appl. No. 16/160,974, filed Oct. 15, 2018.

U.S. Appl. No. 16/160,884, filed Oct. 15, 2018.

GOLF CLUB HEAD

FIELD

This disclosure relates generally to golf clubs, and more particularly to a wood-type golf club head having a high-mass, high-volume sole-mounted weight.

BACKGROUND

Modern "wood-type" golf clubs (notably, "drivers," "fairway woods," and "utility or hybrid clubs"), are generally called "metalwoods" since they tend to be made of strong, lightweight metals, such as titanium. An exemplary metalwood golf club, such as a driver or fairway wood, typically includes a hollow shaft and a golf club head coupled to a lower end of the shaft. Most modern versions of driver-type club heads are made, at least in part, from a lightweight but strong metal, such as a titanium alloy. In most cases, the golf club head is includes a hollow body with a face portion. The face portion has a front surface, known as a strike face, configured to contact the golf ball during a proper golf swing.

Some fairway woods are made of a titanium alloy. However, shortcomings in conventional titanium alloys require thicker walls and additional reinforcements to ensure the fairway woods are durable enough to withstand repeated impacts with a golf ball. These compensations for the shortcomings of conventional titanium alloys can have a negative impact on the performance of the golf club head. For example, thicker walls and additional reinforcements can undesirably raise the center-of-gravity of the golf club head.

SUMMARY

The subject matter of the present application has been developed in response to the present state of the art, and in particular, in response to the shortcomings of golf clubs and associated golf club heads, that have not yet been fully solved by currently available techniques. Accordingly, the subject matter of the present application has been developed to provide a golf club and golf club head that overcome at least some of the above-discussed shortcomings of prior art techniques.

In some examples, the golf club heads of the present disclosure help to improve performance characteristics of wood-type golf club heads by, for example, lower the center-of-gravity of the golf club heads. The center-of-gravity is lowered by making a body of the golf club head out of a material with a lower density and attaching a large weight, made of a higher density material, to the sole of the golf club head. The particular size, shape, and mass of the large weight, relative to the size, shape, and mass of the body, results in a golf club head that achieved improved performance and durability over conventional golf club heads.

Disclosed herein are examples of a golf club head that comprises a body, defining an interior cavity. The body also comprises a sole portion, positioned at a bottom region of the golf club head, a crown portion, positioned at a top region of the golf club head, a skirt portion, positioned around a periphery of the golf club head between the sole portion and the crown portion, and a face portion, positioned at a forward region of the golf club head, opposite a rearward region of the golf club head, and extending from a toe region to a heel region of the golf club head. At least a portion of the body is made of a titanium alloy. The golf club head also comprises a large weight, coupled to the sole portion of the body and made of a steel alloy. A mass of the large weight is at least 40% of a mass of the portion of the body made of the titanium alloy. A total mass of the large weight and the portion of the body made of the titanium alloy is at least 210 grams.

Also disclosed herein are examples of a golf club head that comprises a body, made of a first material having a first material density and comprising a face portion. The golf club head also comprises a large weight, attached to the body and made of a second material having a second material density. A ratio of the second material density to the first material density is at least 1.70, inclusive. The second material of the large weight has a mass that is at least 23%, inclusive, of a mass of the first material of the body. At least 60%, inclusive, of a total mass of the large weight is forward of a theoretical forward-rearward midplane (MP3) of the golf club head that extends parallel to an x-axis of a golf club head origin coordinate system of the golf club head at a midpoint between a forwardmost point of the golf club head and a rearwardmost point of the golf club head. The body comprises a weight mating recess, configured to receive at least a portion of the large weight. The weight mating recess has a depth that varies in a direction away from the face portion of the body. The depth of the weight mating recess is greater proximal the face portion than distal the face portion.

Additionally disclosed herein are examples of a golf club that comprises a shaft comprising a butt end and a tip end. The golf club further comprises a golf club head comprising a body, defining an interior cavity of the golf club head, and further comprising a sole defining a bottom portion of the golf club head, a crown defining a top portion of the golf club head, a skirt portion defining a periphery of the golf club head between the sole and the crown, a face defining a forward portion of the golf club head, and a hosel defining a hosel bore. The body further comprises a shaft attachment port positioned in the sole and extending into the interior cavity. The shaft attachment port has a port width and is located proximate a bottom end of the hosel such that a passage in the bottom end of the hosel provides communication between the hosel bore and the shaft attachment port. The golf club additionally comprises a sleeve mounted on the tip end of the shaft and adapted to be inserted into the hosel bore. The golf club further comprises a fastener having a head portion located in the shaft attachment port and a shaft portion extending through the passage. The shaft portion is selectively attachable to the sleeve when the sleeve is inserted into the hosel bore. The golf club head further comprises a weight attached to a sole portion of the body and defining at least a portion of the sole of the golf club head. The golf club head also comprises a weight recess formed in the sole portion of the body of the golf club head and extending into the interior cavity of the golf club head. The weight recess is configured to receive at least a portion of the weight. The weight recess has a variable depth. At least a portion of the weight recess is located proximate the shaft attachment port. A depth of the weight recess proximate the face is greater than the depth of the weight recess distal the face. The golf club head has an overall height less than about 45 millimeters (mm). The golf club head has a total volume between about 120 cubic centimeters (cc) and about 240 cc inclusive.

Also disclosed herein are examples of a golf club head that comprises a body, comprising a face portion and defining an interior cavity. The golf club head further comprises a large weight that is attached to the body. The body is made of a first material having a first material density of no more than 8 g/cc. The large weight is made of a second material having a second material density of no less than 7 g/cc. The first material density is less than the second material density. A ratio of the second material density to the first material density is at least 1.70, inclusive. At least 60%, inclusive, of a total mass of the large weight is forward of a theoretical forward-rearward midplane (MP3) of the golf club head that extends parallel to an x-axis of a golf club head origin coordinate system of the golf club head at a midpoint between a forwardmost point of the golf club head and a rearwardmost point of the golf club head. The body comprises a weight mating recess, configured to receive at least a portion of the large weight. The weight mating recess has a depth that varies in a direction away from the face portion of the body. The depth of the weight mating recess is greater proximal the face portion than distal the face portion. At least a portion of the large weight crosses the theoretical forward-rearward midplane (MP3) of the golf club head. The large weight has a volume of at least 3 cubic centimeters, inclusive. The large weight defines a portion of a sole of the golf club head. The large weight defines at least 6 square centimeters of a surface area of the sole.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter and are not therefore to be considered to be limiting of its scope, the subject matter will be described and explained with additional specificity and detail through the use of the drawings, in which.

DETAILED DESCRIPTION

The following describes examples of golf club heads in the context of a fairway wood golf club head, but the principles, methods and designs described may be applicable in whole or in part to drivers, utility clubs (also known as hybrid clubs), and the like.

U.S. Patent Application Publication No. 2014/0302946 A1 ('946 App), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003).

Unless otherwise indicated, all parameters are specified with the club head in the reference position.

Figure 2:
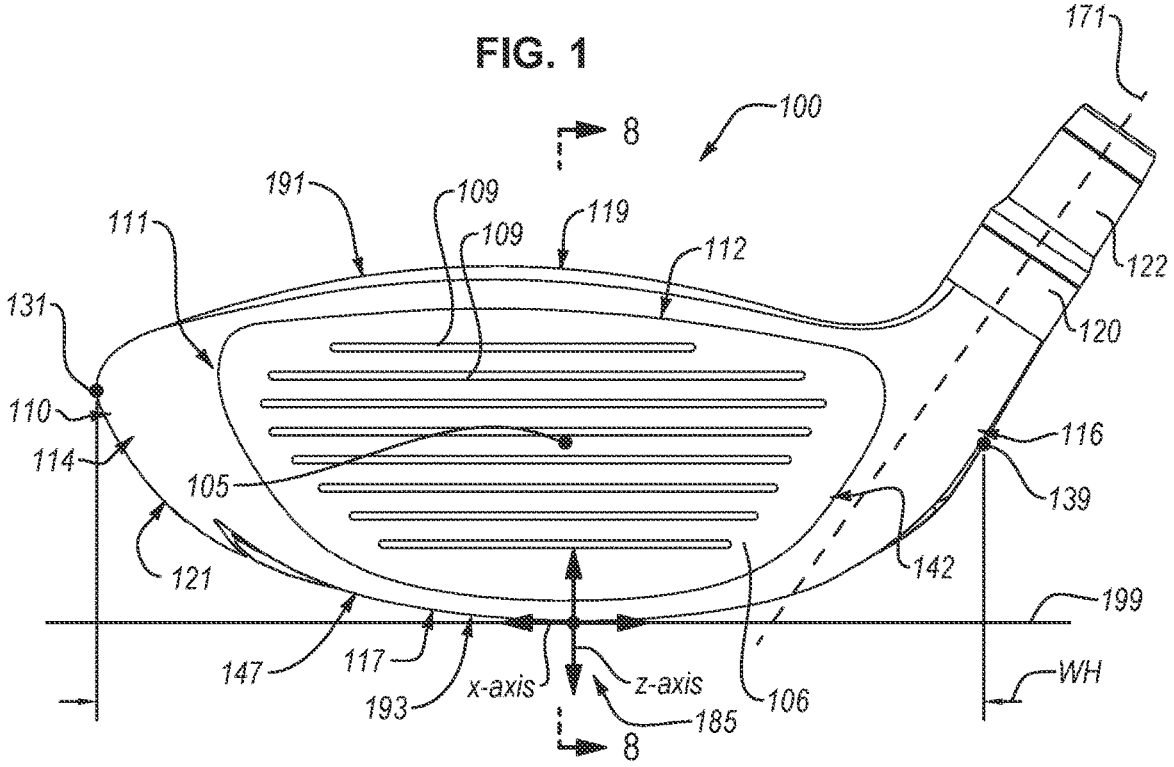
FIG. 2 is a front view of the golf club head of FIG. 1, according to one or more examples of the present disclosure.
Figure 3:
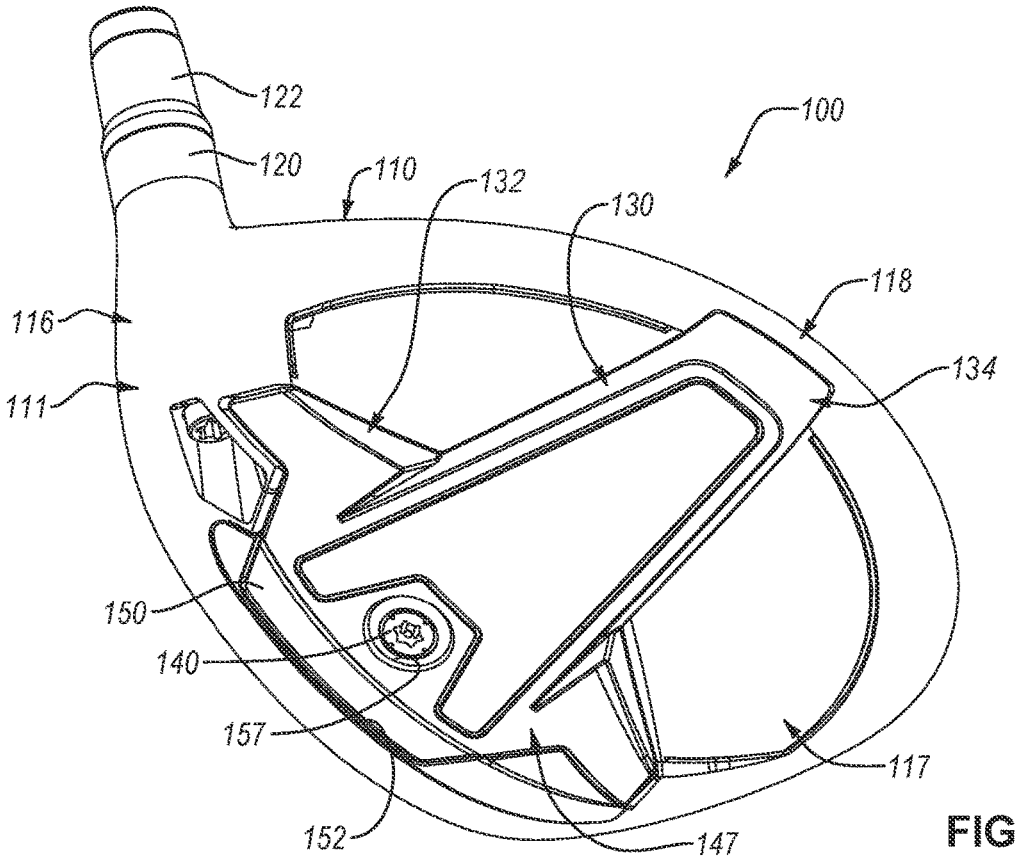
FIG. 3 is a perspective view of the golf club head of FIG. 1, from a bottom-rear of the golf club head, according to one or more examples of the present disclosure.
Figure 6:
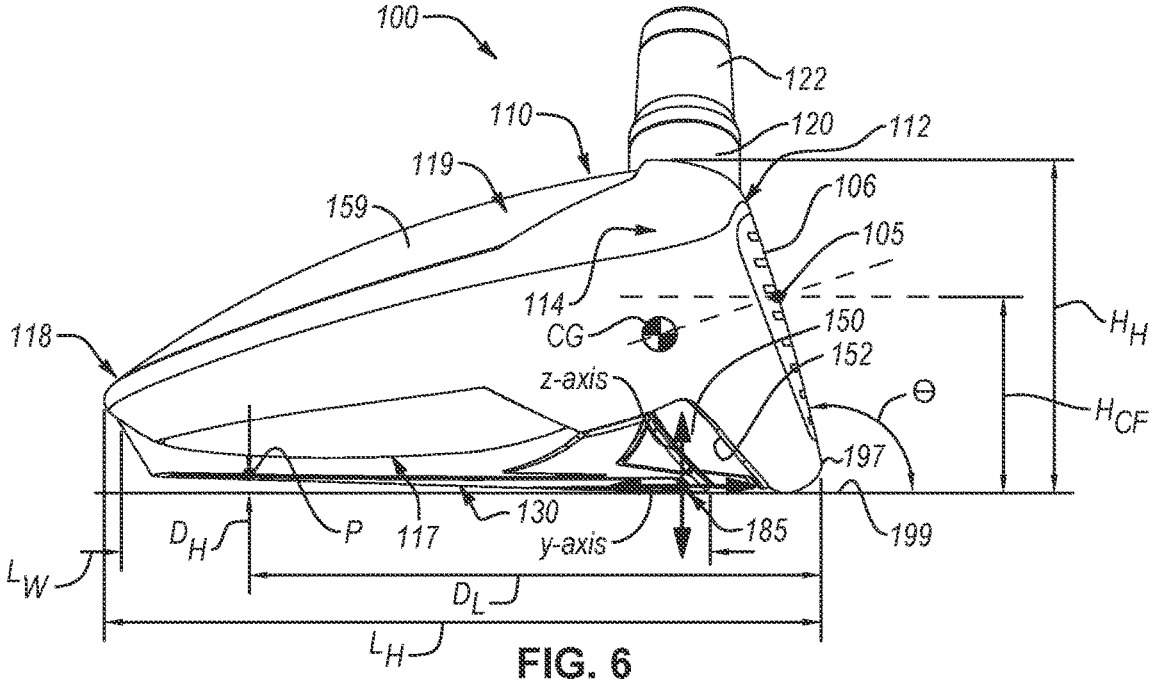
FIG. 6 is a side elevation view of the golf club head of FIG. 1, according to one or more examples of the present disclosure.

FIGS. 2 and 6 are examples that show a golf club head 100 in the address position, i.e. the golf club head 100 is positioned such that a hosel axis 171 of the golf club head 100 is at a 60-degree lie angle relative to a ground plane 199 and a strike face 106 of the golf club head 100 is square relative to an imaginary target line. As shown in FIGS. 2 and 6, positioning the golf club head 100 in the reference position lends itself to using a club head origin coordinate system 185 for making various measurements. Additionally, the USGA methodology may be used to measure the various parameters described throughout this application including head height, club head center of gravity (CG) location, and moments of inertia (MOI) about the various axes.

For further details or clarity, the reader is advised to refer to the measurement methods described in the '946 App and the USGA procedure. Notably, however, the origin and axes used in this application may not necessarily be aligned or oriented in the same manner as those described in the '946 App or the USGA procedure. Further details are provided below on locating the club head origin coordinate system 185.

The golf club head 100 described herein may be a driver-type golf club head with a relatively large strike face of at least 3500 mm^2, preferably at least 3800 mm^2, and even more preferably at least 3900 mm^2. Additionally, the golf club head may include a center of gravity (CG) projection proximate center face 105 that may be at most 3 mm above or below center face 105 of the strike face 106, and preferably may be at most 1 mm above or below center face 105, as measured along a vertical axis (z-axis). Moreover, the golf club head 100 may have a relatively high moment of inertia about the vertical z-axis e.g. Izz>350 kg-mm^2 and preferably Izz>400 kg-mm^2, a relatively high moment of inertia about the horizontal x-axis e.g. Ixx>200 kg-mm^2 and preferably Ixx>250 kg-mm^2, and preferably a ratio of Ixx/Izz>0.55.

In other examples, the golf club head 100 is a fairway-type golf club head with a strike face that is relatively smaller than a driver-type golf club head. For example, the strike face 106 has an area of at least 1,500 mm^2 and at most 3,000 mm^2, in some implementations. Furthermore, in some examples, the loft of the golf club head 100 is between 15-degrees and 30-degrees, inclusive. Additionally, in certain examples, the golf club head 100 has a CG projection proximate center face 105 that may be at most 5 mm above or below center face 105 of the strike face 106, and preferably may be at most 3 mm above or below center face 105, as measured along a vertical axis (z-axis). Moreover, the golf club head 100 may have a moment of inertia about the vertical z-axis (e.g. Izz>150 kg-mm^2 and Izz<370 kg-mm^2, or Izz>180 kg-mm^2 and Izz<300 kg-mm^2) and a moment of inertia about the horizontal x-axis (e.g. Ixx). In certain examples, Izz is at least 1.5 times Ixx, such as at least 1.75 times Ixx. Additionally, the golf club head 100 of these examples may have a Zup value that is greater than about 20 mm.

The golf club head 100 disclosed herein may have a volume equal to the volumetric displacement of the body 110 of the golf club head 100. For example, the golf club head 100 of the present application can be configured to have a head volume between about 110 $cm^3$ and about 600 $cm^3$, such as greater than 150 $cm^3$. In more particular examples, the head volume may be between about 120 $cm^3$ and about 240 $cm^3$ or between about 250 $cm^3$ and about 500 $cm^3$. In yet more specific embodiments, the head volume may be between about 300 $cm^3$ and about 500 $cm^3$, between about 300 $cm^3$ and about 360 $cm^3$, between about 300 $cm^3$ and about 420 $cm^3$ or between about 420 $cm^3$ and about 500 $cm^3$. In the case of a driver, the golf club head 100 may have a volume between about 300 $cm^3$ and about 460 $cm^3$, and a total mass between about 145 grams (g) and about 245 g. In the case of a fairway wood, the golf club head 100 may have a volume between about 100 $cm^3$ and about 250 $cm^3$, and a total mass between about 145 g and about 260 g. In the case of a utility or hybrid club the golf club head 100 may have a volume between about 60 $cm^3$ and about 150 $cm^3$, and a total mass between about 145 g and about 280 g.

Figure 1:
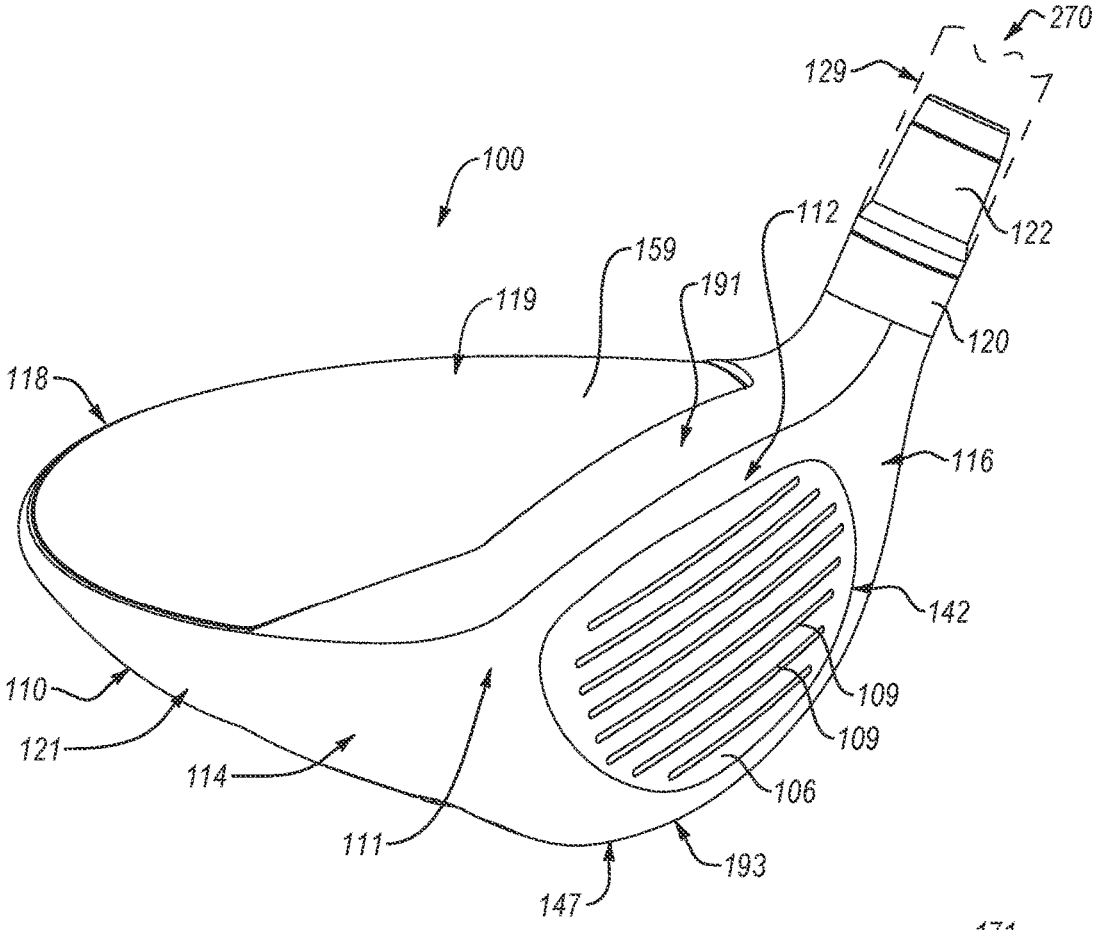
FIG. 1 is a perspective view of a golf club head, from a top-front of the golf club head, according to one or more examples of the present disclosure.

Referring to FIGS. 1 and 2, the golf club head 100 of the present disclosure includes a body 110. The body 110 has a toe region 114 and a heel region 116, opposite the toe region 114. Additionally, the body 110 includes a forward region 112 and a rearward region 118, opposite the forward region 112. The body 110 further includes a face portion 142 at the forward region 112 of the body 110. The body 110 of the golf club head 100 additionally includes a sole portion 117, at a bottom region 193 of the golf club head 100 and at least partially defining a sole 147 of the golf club head 100, and a crown portion 119, opposite the sole portion 117 and at a top region 191 of the golf club head 100 and defining a crown of the golf club head 100. Also, the body 110 of the golf club head 100 includes a skirt portion 121 that defines a transition region where the body 110 of the golf club head 100 transitions between the crown portion 119 and the sole portion 117. Accordingly, the skirt portion 121 is located between the crown portion 119 and the sole portion 117 and extends about a periphery of the golf club head 100 to define a skirt of the golf club head 100. The face portion 142 extends along the forward region 112 from the sole portion 117 to the crown portion 119. Moreover, the exterior surface, and at least a portion of the interior surface, of the face portion 142 is planar in a top-to-bottom direction. As further defined, the face portion 142 is the portion of the body 110 at the forward region 112 with an exterior surface that faces in the generally forward direction.

Figure 7:
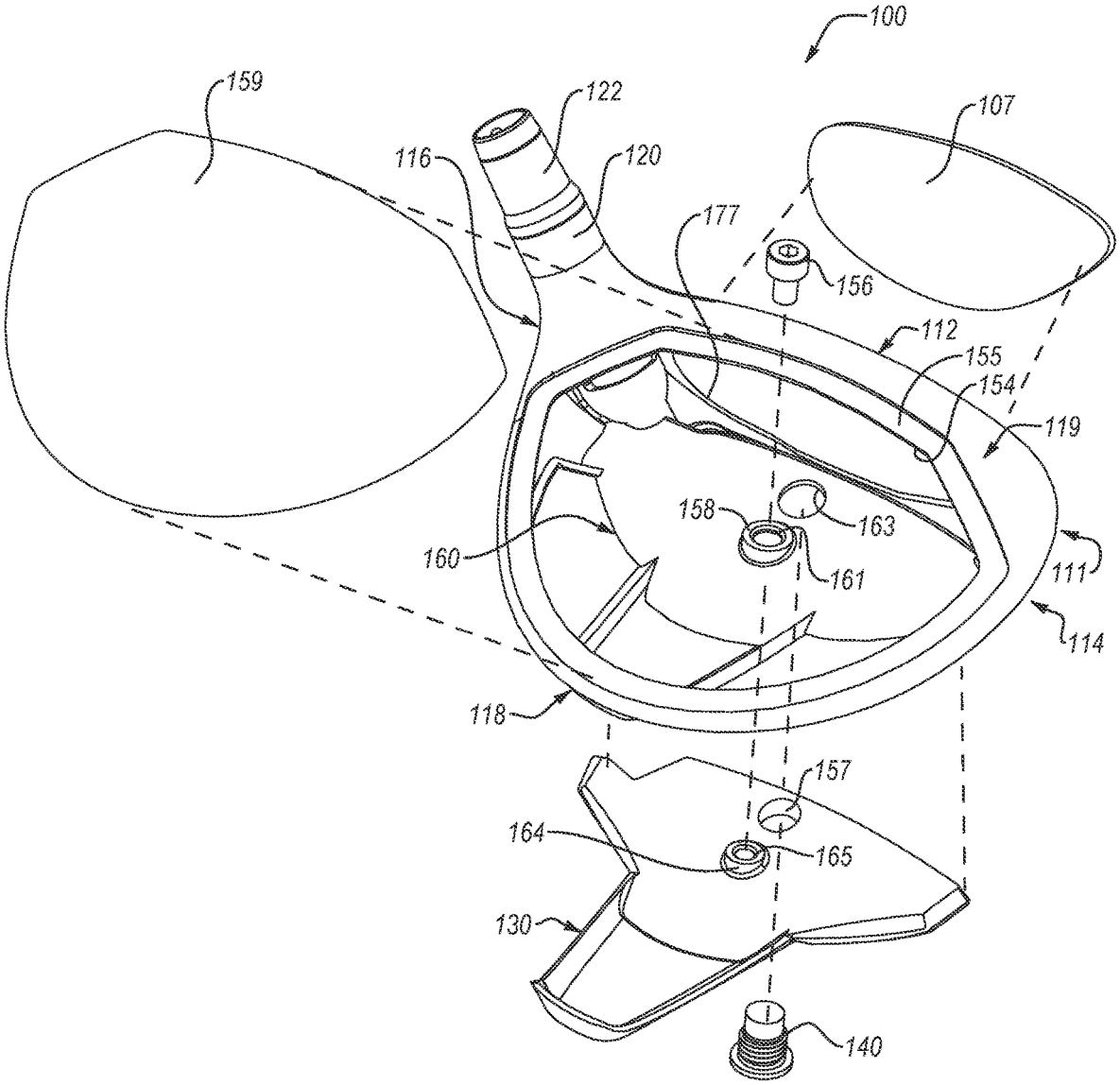
FIG. 7 is an exploded perspective view of the golf club head of FIG. 1, from a top-rear of the golf club head, according to one or more examples of the present disclosure.

In some examples, as shown in FIG. 7, the face portion 142 includes a front aperture 177 and a strike plate 107 coupled to and closing the front aperture 177. The strike plate 107 defines a strike face 106 configured to impact and drive the golf ball during a normal swing of the golf club head 100. In certain implementations, the strike plate 107 is made from the same material as or a different material than a cast frame 111 of the body 110 to which the strike plate 107 is attached. For example, the strike plate 107 can be made from a first titanium alloy and the cast frame 111 can be made from a second titanium alloy that is different than the first titanium alloy. Although in FIG. 7 the strike plate 107 is formed separately from a cast frame 111 of the body 110 and attached (e.g., welded, braised, soldered, screwed, or otherwise coupled) to the cast frame 111, in other examples, the strike face 106 is co-formed (e.g., co-cast) with the cast frame 111 to form the face portion 142 of the body 110 as a one-piece monolithic construction with the cast frame 111.

In some examples, the strike face 106 includes undulations as shown and described in U.S. patent application Ser. No. 16/160,974, filed Oct. 15, 2018, and U.S. patent application Ser. No. 16/160,884, filed Oct. 15, 2018, which are both incorporated herein by reference in their entirety.

The cast frame 111 is the portion of the body 110 that is made of metal and cast as a single one-piece monolithic construction. Generally, the cast frame 111 provides a framework or skeleton of the golf club head 100 to strengthen the golf club head 100 in areas of high stress caused by the impact of a golf ball with the face portion 142. Such areas include a transition region where the golf club head 100 transitions from the face portion 142 to the crown portion 119, the sole portion 117, and the skirt portion 121 of the body 110. As shown in FIG. 7, internal surfaces of the cast frame 111 partially defines the interior cavity 160 of the golf club head 100. The internal surfaces of the cast frame 111 includes several interconnected surfaces that are angled relative to each other. According to one example, the golf club head 100 has no internal ribs intercoupling or extending between any two interconnected surfaces, of the internal surfaces of the cast frame 111, that are angled relative to each other. In other words, the cast frame 111 is rib-less. As defined herein a rib is a tall and thin structure with a height or length that is at least 2-times, at least 3-times, or at least 4-times a thickness of the structure and with a height that is at least 1.5 mm. Normally, ribs are required to stiffen a golf club head and to dampen the acoustics of the golf club head when impacted by a golf ball. However, because the large weight 130, described below, helps to stiffen the golf club head 100 and dampen the acoustics of the golf club head 100, no ribs are necessary. Moreover, because ribs add mass to the golf club head 100, getting rid of the ribs increases the discretionary mass of the golf club 100 that can be relocated to other areas of the golf club head 100 for improving the performance of the golf club head 100.

When cast together, the strike face 106 and the cast frame 111 are made of the same material, such as any of various materials described below. However, welding a strike plate 107 to the cast frame 111, as opposed to co-forming the strike face 106 as a one-piece construction with the cast frame 111, allows the strike plate 107 and strike face 106 to be made from a different material, such as any of those described below, and/or made by a different manufacturing process, than the cast frame 111. According to certain implementations, the forward region 112 of the body 110, defining the strike face 106, includes variable thickness features similar to those described in more detail in U.S. patent application Ser. No. 12/006,060; and U.S. Pat. Nos. 6,997,820; 6,800,038; and 6,824,475, which are incorporated herein by reference in their entirety.

The golf club head 100 also includes a hosel 120 extending from the heel region 116 of the golf club head 100. As shown in FIG. 1, a tip end of a shaft 129 of a golf club 270 may be attached directly to the hosel 120 or, alternatively, attached indirectly to the hosel 120, such as via a flight control technology (FCT) component 122 (e.g., an adjustable lie/loft assembly) coupled with the hosel 120. The golf club 270 also includes a grip fitted around a distal end or butt end of the shaft 129. The grip of the golf club 270 helps promote the handling of the golf club 270 by a user during a golf swing. The hosel axis 171, which is coaxial with the shaft 272, defining a central axis of the hosel 120.

In some examples, the body 110 of the golf club head 100 includes one or more inserts coupled to the cast frame 111. For example, the crown portion 119 of the body 110 includes a crown insert 159 attached to the cast frame 111 at the top region 191 of the golf club head 100. For example, the cast frame 111 of the body 110 includes a crown aperture 154 or crown opening, sized and configured to receive the crown insert 159. The crown aperture 154 receives and fixedly secures the crown insert 159. The crown aperture 154 is formed to have a peripheral lip 155 or recess to seat the crown insert 159, such that the crown insert 159 is either flush with the cast frame 111 to provide a smooth seamless outer surface or, alternatively, slightly recessed. It is recognized that in some examples, instead of a crown insert 159, an entirety of the crown portion 119 is co-formed with the cast frame 111 to form a one-piece monolithic construction with the cast frame 111.

In some examples, the body 110 (e.g., just the cast frame 111 of the body 110) and/or the face portion 142 is made of a titanium alloy (including but not limited to 9-1-1, 6-4, 3-2.5, 6-4, SP700, 15-3-3-3, 10-2-3, or other alpha/near alpha, alpha-beta (e.g., ZA1300), and beta/near beta titanium alloys) or mixtures thereof. In one example, the titanium alloy of the body 110 is a 9-1-1 titanium alloy. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and –6% elongation. In certain examples, the titanium alloy is 8-1-1 Ti.

In another example, the titanium alloy of the body 110 is an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" or "ZA1300" titanium alloy). In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative example, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative example, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative example, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain embodiments may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some embodiments, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular examples, the Ti-8Al-2.5Mo-2Cr-1V-

0.5Fe alloy can have a tensile strength of about 1320 MPa, a yield strength of about 1284 MPa, and an elongation of about 10%. The Ti-8Al-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the strike face 106 of the golf club head 100 will maintain its original shape over time.

According to some examples, the face portion 142 is made of a first alloy of a first material and other portions of the body 110 are made of a second alloy of the first material. The first alloy is different than the second alloy. For example, the first alloy can be ZA 1300 titanium alloy and the second alloy can be 6-4 titanium alloy. In another example, the first alloy is 9-1-1 titanium alloy and the second alloy is 6-4 titanium alloy. Accordingly, in some examples, the ultimate tensile strength (UTS) of the titanium alloy of the face portion 142 is greater than (e.g., 10% greater than) the UTS of the titanium alloy of the body 110. In certain examples, the material of the face portion 142 has a UTS greater than 1,000 MPa, greater than 1,100 MPa, or greater than 1,200 MPa, and the material of the body 110 has a UTS less than 1,100 MPa or less than 1,000 MPa. According to some examples, the material of the face portion 142 and the material of the body 110 include aluminum such that the mass percentage of aluminum in the face portion 142 is greater than 7% and the mass percentage of aluminum in the body 110 is less than 7%. In certain examples, the difference in the mass percentage of aluminum in the material of the face portion 142 and the mass percentage of aluminum in the material of the body 110 is at least 0.5%. According to some examples, the material of the face portion 142 and the material of the body 110 include molybdenum such that the mass percentage of molybdenum in the face portion 142 is greater than 1.9% and the mass percentage of molybdenum in the body 110 is less than 1.9%.

In certain examples described in this paragraph, the strike plate 107 has a thickness of between 2.6 mm and 2.8 mm, such as 2.7 mm, or between 2.8 mm and 3.0 mm, such as 2.9 mm. Correspondingly, a thickness of the face portion 142, at locations above the strike plate 107 and within 20 mm toeward and heelward of centerface, is between 2.5 mm and 2.7 mm, such as 2.6 mm, or between 2.7 mm and 2.9 mm, such as 2.8 mm. A thickness of the face portion 142, at locations below the strike plate 107 and within 10 mm toeward and heelward of centerface, is between 2.4 mm and 2.6 mm, such as 2.5 mm, or between 2.6 mm and 2.8 mm, such as 2.7 mm. A thickness of the face portion 142, at locations below the strike plate 107 and at least 20 mm toeward and heelward of centerface, is between 1.7 mm and 1.9 mm, such as 1.8 mm, or between 1.9 mm and 2.1 mm, such as 2.0 mm. A thickness of the face portion 142, at locations heelward and toeward of the strike plate 107, is between 1.7 mm and 1.9 mm, such as 1.8 mm, or between 1.9 mm and 2.1 mm, such as 2.0 mm.

According to some examples, the crown insert 159 and/or the face portion 142 are formed of a non-metal material with a density less than about 2 g/cc, such as between about 1 g/cc to about 2 g/cc. The non-metal material may include a polymer or polymer-reinforced composite material (e.g., a carbon fiber material having a matrix made of the non-metal material). The polymer can be either thermoset or thermoplastic, and can be amorphous, crystalline and/or a semi-crystalline structure.

The polymer may also be formed of an engineering plastic such as a crystalline or semi-crystalline engineering plastic or an amorphous engineering plastic. Potential engineering plastic candidates include polyphenylene sulfide ether (PPS), polyamides, polypropylene, thermoplastic polyurethanes, thermoplastic polyureas, polyamide-amides (PAI), polyethelipide (PEI), polycarbonate (PC), polypropylene (PP), acrylonitrile-butadience styrene plastics (ABS), polyoxymethylene plastic (POM), nylon 6, nylon 6-6, nylon 12, polymethyl methacrylate (PMMA), polypheylene oxide (PPO), polybothlene terephthalate (PBT), polysulfone (PSU), polyether sulfone (PES), polyether ether ketone (PEEK) or mixtures thereof. Organic fibers, such as fiberglass, carbon fiber, or metallic fiber, can be added into the engineering plastic, so as to enhance structural strength. The reinforcing fibers can be continuous long fibers or short fibers. One of the advantages of PSU is that it is relatively stiff with relatively low damping which produces a better sounding or more metallic sounding golf club compared to other polymers which may be overdamped. Additionally, PSU requires less post processing in that it does not require a finish or paint to achieve a final finished golf club head.

Other polymeric materials may include, without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyethelipides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfoner (PPSU).

Particularly important and preferred aromatic polysulfones are those comprised of repeating units of the structure —C6H4SO2-C6H4-O— where C6H4 represents a m- or p-phenylene structure. The polymer chain can also comprise repeating units such as —C6H4-, C6H4-O—, —C6H4-(lower-alkylene)-C6H4-O—, —C6H4-O—C6H4-O—, —C6H4-S—C6H4-O—, and other thermally stable substantially-aromatic difunctional groups known in the art of engineering thermoplastics. Also included are the so called modified polysulfones where the individual aromatic rings are further substituted in one or substituents including

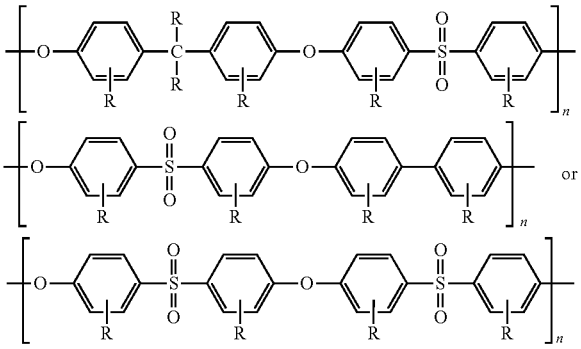

or wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropepyl, butenyl, isobutenyl, pentenyland hexenyl groups. As specific examples of the C3-C20 cycloalkyl group, there can be mentioned cyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

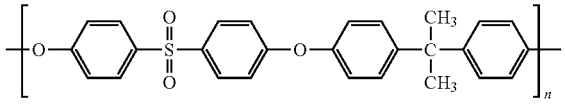

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

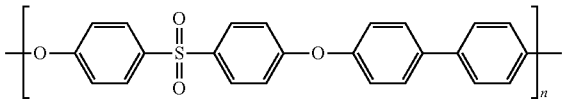

and the abbreviation PPSF and sold under the tradenames RADEL® resin; and (c) a condensation polymer made from 4,4'-dichlorodiphenyl sulfone in the presence of base and having the principle repeating structure

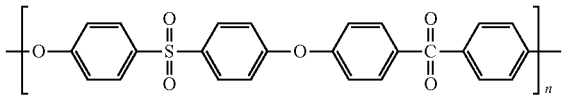

and the abbreviation PPSF and sometimes called a "polyether sulfone" and sold under the tradenames Ultrason® E, LNP™, Veradel®PESU, Sumikaexce, and VICTREX® resin," and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present). Examples of some of these composite materials for use in the metalwood golf clubs and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12/004,387, 11/960,609, 11/960,610, and 12/156,947, which are incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

One exemplary material from which the crown insert 159 may be made is a thermoplastic continuous carbon fiber composite laminate material having long, aligned carbon fibers in a PPS (polyphenylene sulfide) matrix or base. A commercial example of a fiber-reinforced polymer, from which the crown insert 159 may be made, is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 g/m$^2$. Another commercial example of a fiber-reinforced polymer, from which a sole insert and/or the crown insert 126 is made, is TEPEX® DYNALITE 208. This material also has a carbon fiber volume range of 42 to 57%, including a 45% volume in one example, and a weight of 200 g/m2. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming the crown insert 159. After the crown insert 159 is formed (separately, in some implementations) by the thermoforming process, it is cooled and removed from the matched die. In some implementations, the crown insert 159 has a uniform thickness, which facilitates use of the thermoforming process and ease of manufacture. However, in other implementations, the crown insert 159 may have a variable thickness to strengthen select local areas of the insert by, for example, adding additional plies in select areas to enhance durability, acoustic properties, or other properties of the insert.

In some examples, the crown insert 159 is made by a process other than thermoforming, such as injection molding or thermosetting. In a thermoset process, the crown insert 159 may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the crown insert 159. The insert is cooled and removed from its mold.

The carbon fiber reinforcement material for the crown insert 159, made by the thermoset manufacturing process, may be a carbon fiber known as "34-700" fiber, available from Grafil, Inc., of Sacramento, Calif., which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, Calif. In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the plipary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

The crown insert 159 has a complex three-dimensional shape and curvature corresponding generally to a desired shape and curvature of the crown portion 119 of the golf club head 100.

Referring to FIGS. 3, 4, 8, and 12, in some examples, the golf club head 100 includes a sole slot 152 formed in the sole portion 117 of the body 110 at the forward region 112 of the golf club head. The sole slot 152 is open to an exterior of the golf club head 100 and extends lengthwise from the heel region 116 to the toe region 114 (e.g., heel-to-toe direction). More specifically, the sole slot 152 is elongated in a lengthwise direction substantially parallel to, but offset from, the face portion 142. Generally, the sole slot 152 is a groove or channel formed in the sole portion 117 of the body 110 of the golf club head 100. In some implementations, the sole slot 152 is a through-slot, which is a slot that is open on a sole portion side of the sole slot 152 and open to an interior cavity 160 of the body 110 or on an interior side of the sole slot 152. However, in other implementations, the sole slot 152 is not a through-slot, but rather is closed on an interior cavity side or interior side of the sole slot 152. For example, the sole slot 152 can be defined by a portion of the side wall of the sole portion 117 of the body 110 that protrudes into the interior cavity 160 and has a concave exterior surface having any of various cross-sectional shapes, such as a substantially U-shape, V-shape, and the like.

Figure 5:
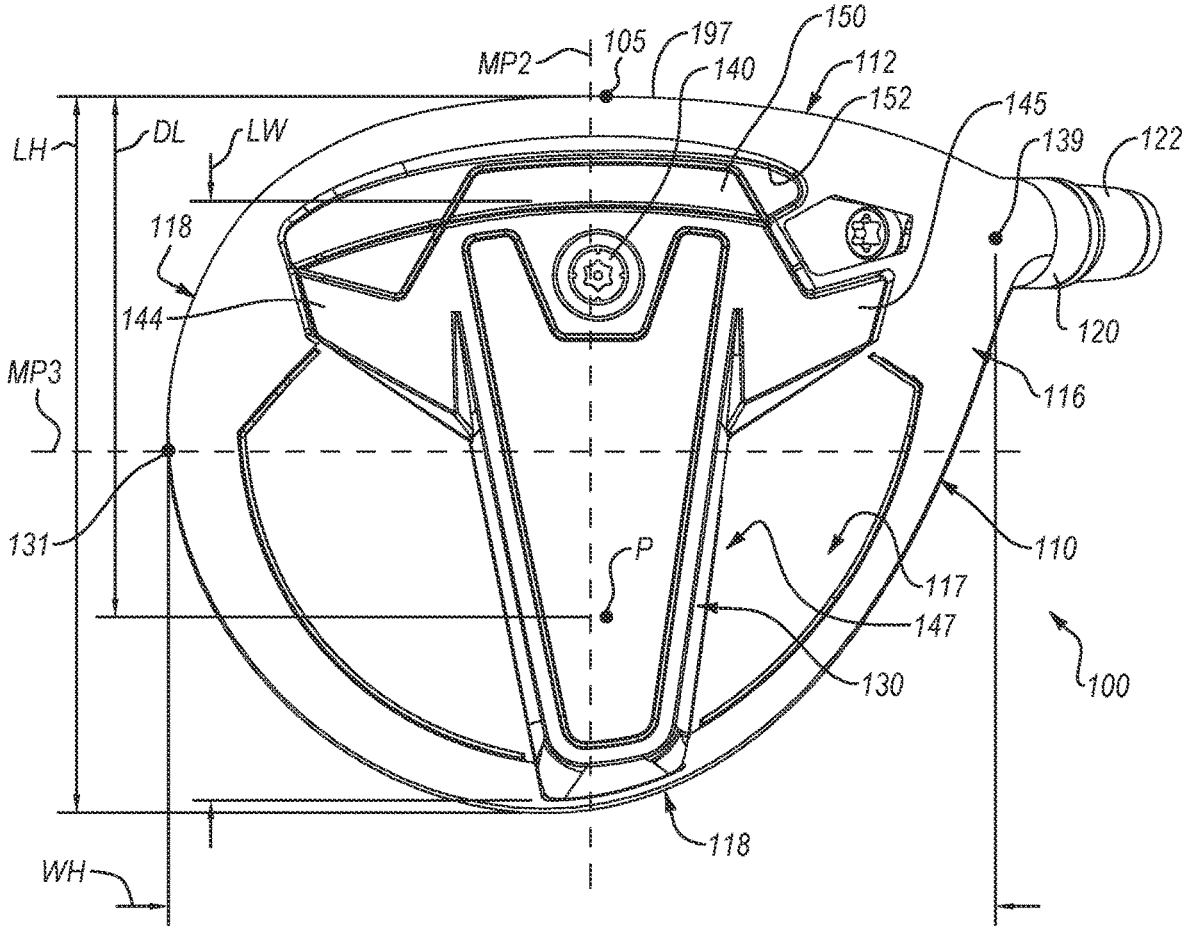
FIG. 5 is a bottom plan view of the golf club head of FIG. 1, according to one or more examples of the present disclosure.

In some examples, the sole slot 152 is asymmetrical, which as used herein, means asymmetrical about any plane parallel to an YZ-plane of the golf club head 100. Referring to FIG. 5, in certain examples, the sole slot 152 extends further toeward than heelward relative to the theoretical toe-heel midplane MP2 of the golf club head 100 as defined below.

The sole slot 152 can be any of various flexible boundary structures (FBS) as described in U.S. Pat. No. 9,044,653, issued Jun. 2, 2015, which is incorporated by reference herein in its entirety. Additionally, or alternatively, the golf club head 100 can include one or more other FBS at any of various other locations on the golf club head 100. The sole slot 152 may be made up of curved sections, or several segments that may be a combination of curved and straight segments. Furthermore, the sole slot 152 may be machined or cast into the golf club head 100. Although shown in the sole portion 117 of the golf club head 100, a slot similar to the sole slot 152 may, alternatively or additionally, be incorporated into the crown portion 119 of the golf club head 100.

In some implementations, the sole slot 152 is filled with a filler material 150. However, in other implementations, the sole slot 152 is not filled with a filler material, but rather maintains an open, vacant, space within the sole slot 152. When used, the filler material 150 can be made from a non-metal, such as a thermoplastic material, thermoset material, and the like, in some implementations. In certain examples, the filler material 150 prevents dirt and other debris from entering the slot and possibly the interior cavity 160 of the golf club head 100 when the sole slot 152 is a through-slot. The filler material 150 may be any relatively low modulus materials including polyurethane, elastomeric rubber, polymer, various rubbers, foams, and fillers. The filler material should not substantially prevent deformation of the golf club head 100 when in use as this would counteract the pelipeter flexibility.

According to one example, the filler material 150 is initially a viscous material that is injected or otherwise inserted into the sole slot 152. Examples of materials that may be suitable for use as the filler material 150 to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some examples, the filler material 150 is a solid material that is press-fit or adhesively bonded into the sole slot 152. In other examples, the filler material 150 may poured, injected, or otherwise inserted into the sole slot 152 and allowed to cure in place, forming a sufficiently hardened or resilient outer surface. In still other examples, the filler material 150 may be placed into the sole slot 152 and sealed in place with a resilient cap or other structure formed of a metal, metal alloy, metallic, composite, hard plastic, resilient elastomeric, or other suitable material.

Although not shown, in some examples, the sole slot 152 functions as a weight track for adjustably retaining at least one weight within the sole slot 152. Accordingly, the sole slot 152 is defined as a forward or lateral weight track in some implementations.

In some examples, the sole slot 152 is offset from the face portion 142 by an offset distance, which is the minimum distance between a first vertical plane passing through a center of the strike plate of the face portion 142 and the slot at the same x-axis coordinate as a center face 105 of the strike face 106, between about 5 mm and about 50 mm, such as between about 5 mm and about 35 mm, such as between about 5 mm and about 30 mm, such as between about 5 mm and about 20 mm, or such as between about 5 mm and about 15 mm.

Figure 4:
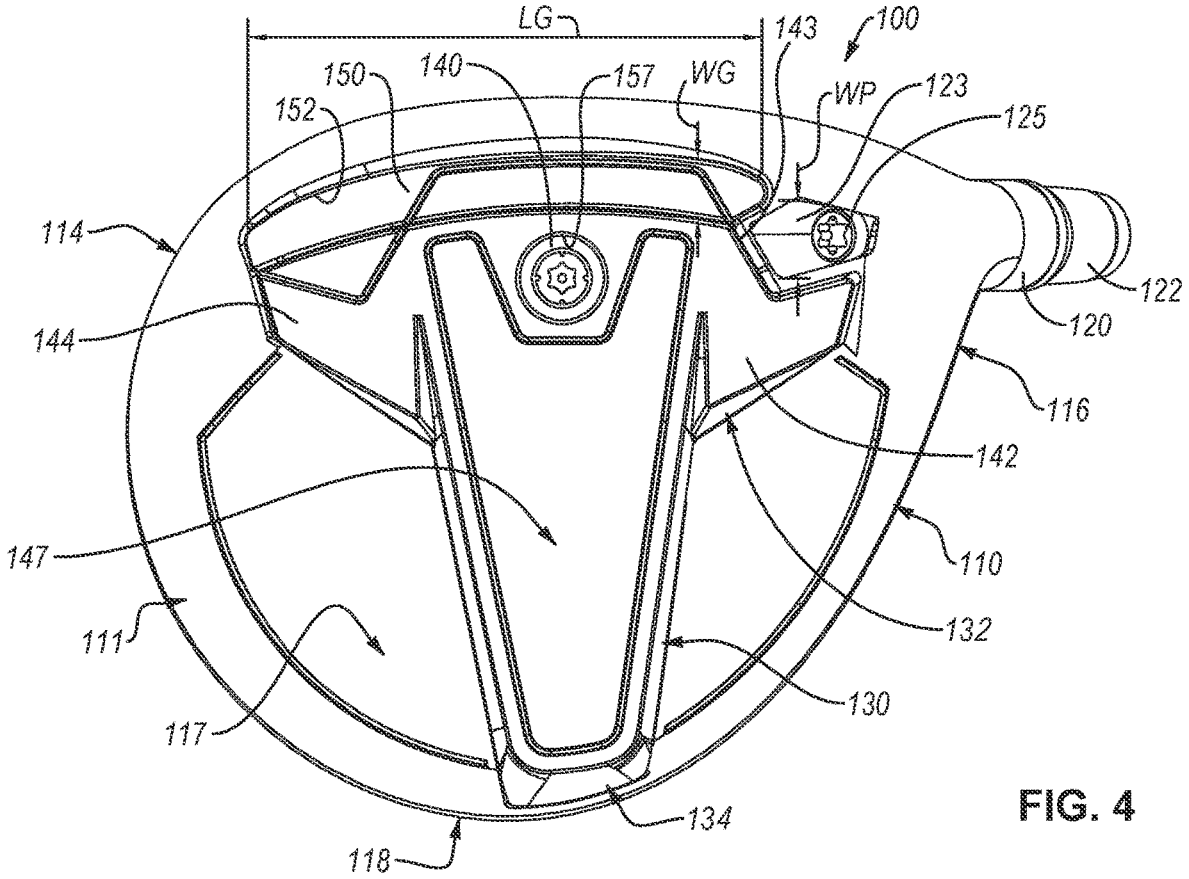
FIG. 4 is a bottom plan view of the golf club head of FIG. 1, according to one or more examples of the present disclosure.

The sole slot 152 has a certain slot width WG, which is measured as a horizontal distance between a first slot wall and a second slot wall (see, e.g., FIG. 4). In some examples, the width of the sole slot 152 may be between about 5 mm and about 20 mm, such as between about 10 mm and about 18 mm, or such as between about 12 mm and about 16 mm. According to some examples, the depth of the sole slot 152 (i.e., the vertical distance between a bottom slot wall and an imaginary plane containing the regions of the sole adjacent the first and second slot walls of the sole slot 152) may be between about 6 mm and about 20 mm, such as between about 8 mm and about 18 mm, or such as between about 10 mm and about 16 mm.

Additionally, the sole slot 152 has a certain slot length LG, which can be measured as the horizontal distance between a slot end wall and another slot end wall (see, e.g., FIG. 4). The length of the sole slot 152 may be between about 30 mm and about 120 mm, such as between about 50 mm and about 100 mm, or such as between about 60 mm and about 90 mm. Additionally, or alternatively, the length of the sole slot 152 may be represented as a percentage of a length of the strike plate of the face portion 142. For example, the sole slot 152 may be between about 30% and about 100% of the length of the strike plate, such as between about 50% and about 90%, or such as between about 60% and about 80% mm of the length of the strike plate.

In some instances, the sole slot 152 is a feature to improve and/or increase the coefficient of restitution (COR) across the strike face 106 of the face portion 142. With regards to a COR feature, the sole slot 152 may take on various forms such as a channel or through slot. The COR of the golf club head 100 is a measurement of the energy loss or retention between the golf club head 100 and a golf ball when the golf ball is struck by the golf club head 100. Desirably, the COR of the golf club head 10 is high to promote the efficient transfer of energy from the golf club head 100 to the ball during impact with the ball. Accordingly, the COR feature of the golf club head 100 promotes an increase in the COR of the golf club head 100. Generally, the sole slot 152 increases the COR of the golf club head 100 by increasing or enhancing the pelipeter flexibility of the strike face 106 of the face portion 142 of the golf club head 100. According to some examples, the COR of the golf club head 100 is at least 0.80, inclusive, at least 0.81, inclusive, or at least 0.82, inclusive.

Further details concerning the sole slot 152 as a COR feature of the golf club head 100 can be found in U.S. patent application Ser. Nos. 13/338,197, 13/469,031, 13/828,675, filed Dec. 27, 2011, May 10, 2012, and Mar. 14, 2013, respectively, U.S. patent application Ser. No. 13/839,727, filed Mar. 15, 2013, U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference.

Referring to FIGS. 3-6, 7, 8, and 13-18, in addition to the body 110, the golf club head 100 further comprises a large weight 130. The large weight 130 is coupled (e.g., attached) to the sole portion 117 of the body 110. More specifically, the large weight 130 is coupled to the cast frame 111 at the sole portion 117 of the body 110, and thus defines at least a portion of a sole 147 of the golf club head 100. For example, in one implementation, the large weight 130 defines at least 6 square centimeters of the surface area of the sole 147 of the golf club head 100. As one example, the large weight 130 defines no more than 4 square centimeters of the interior cavity 160. The large weight 130 is non-movably and non-releasably fixed to the sole portion 117 when coupled to the sole portion 117 in some examples. However, in some examples, the large weight 130 can be non-movably, but releasably, fixed to the sole portion 117. In other words, the large weight 130 can be released from the sole portion 117, such as by loosening a bolt 156, in some examples. As shown in FIG. 7, the large weight 130 is fixed to the sole portion 117 at least partially with a bolt 156 in certain examples. For example, the large weight 130 can be fixed to the sole portion 117 at least partially by an adhesive or bonding agent, as well as by the bolt 156.

In the illustrated example, the cast frame 111 includes an interior boss 158 formed in the sole portion 117 and protruding into the interior cavity 160 of the body 110. The interior boss 158 defines a second bolt hole 161 that passes, coaxially, through the interior boss 158. The second bolt hole 161 is a through-hole that is open on one side to the interior cavity 160 and open on an opposite side to the exterior of the body 110.

Figure 8:
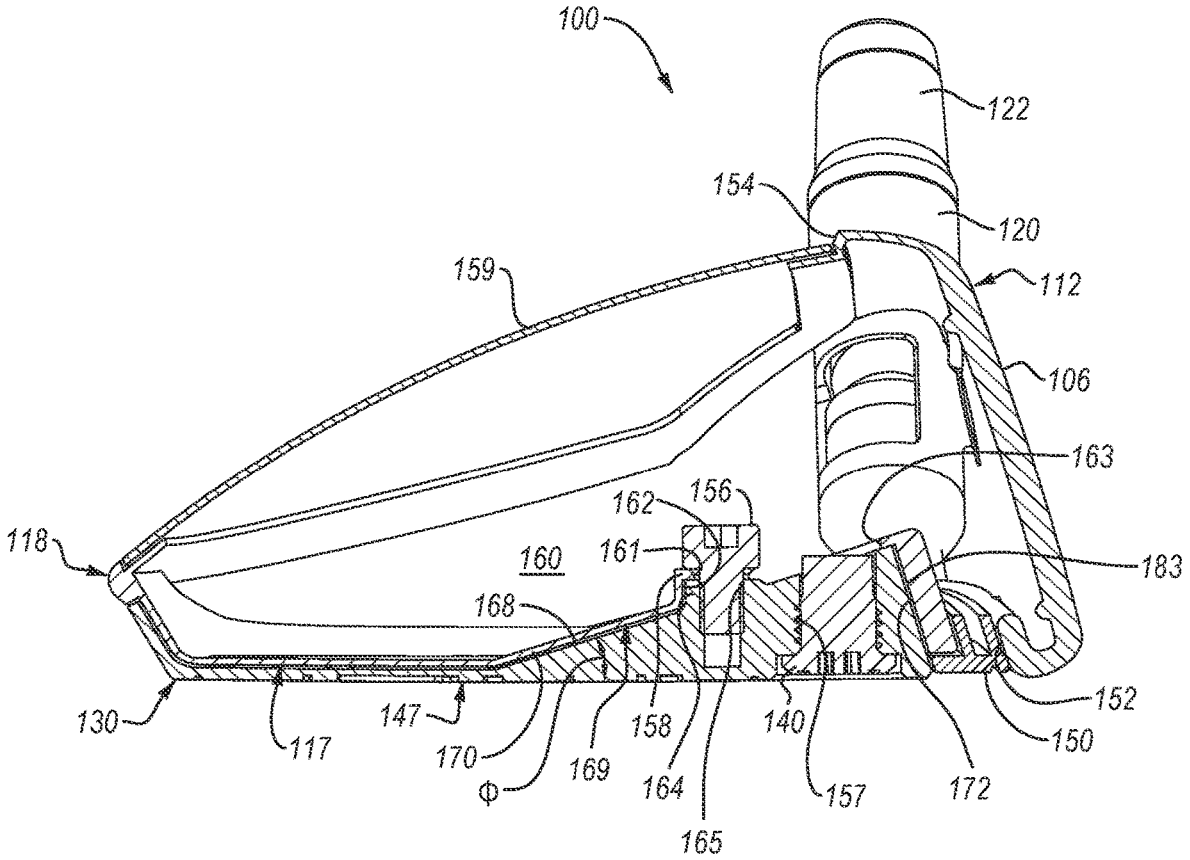
FIG. 8 is a cross-sectional side elevation view of the golf club head of FIG. 1, taken along the line 8-8 of FIG. 2, according to one or more examples of the present disclosure.
Figure 9:
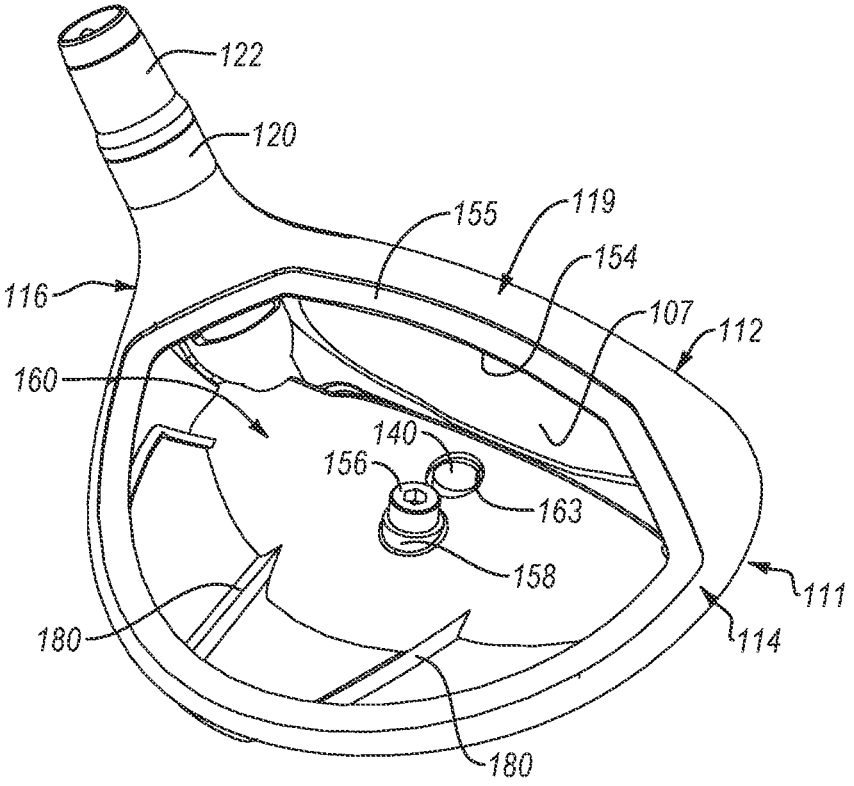
FIG. 9 is a perspective view of the golf club head of FIG. 1, from a top-rear of the golf club head and shown with a crown insert removed, according to one or more examples of the present disclosure.
Figure 10:
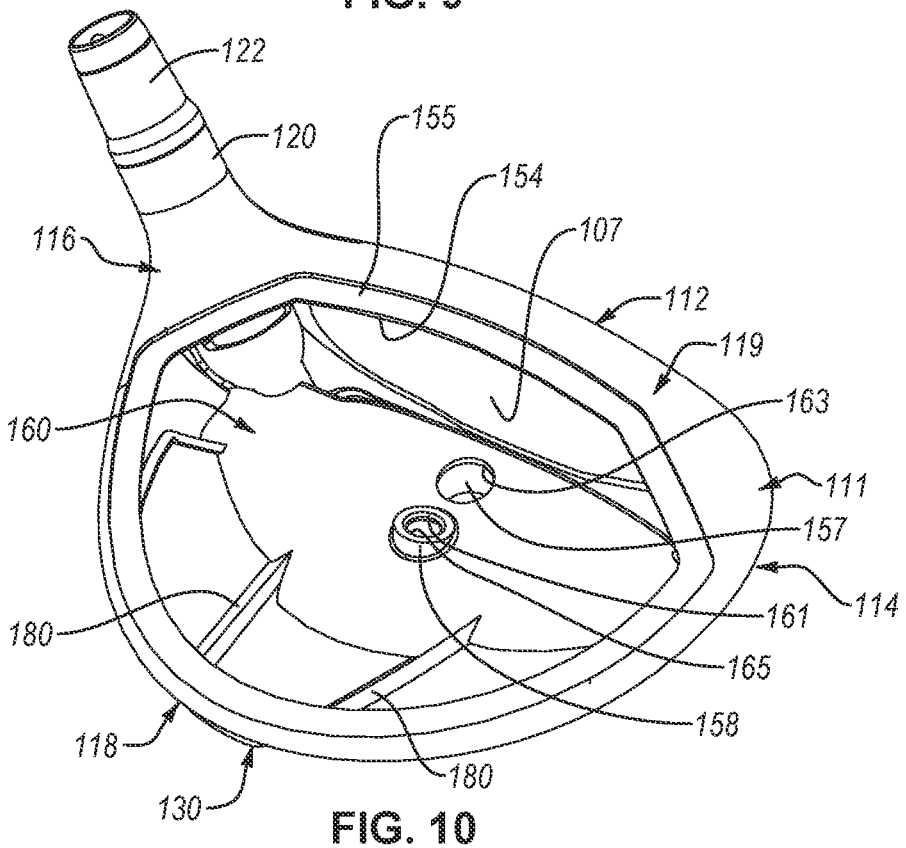
FIG. 10 is a perspective view of the golf club head of FIG. 1, from a top-rear of the golf club head and shown with a crown insert, a bolt, and a small weight removed, according to one or more examples of the present disclosure.
Figure 11:
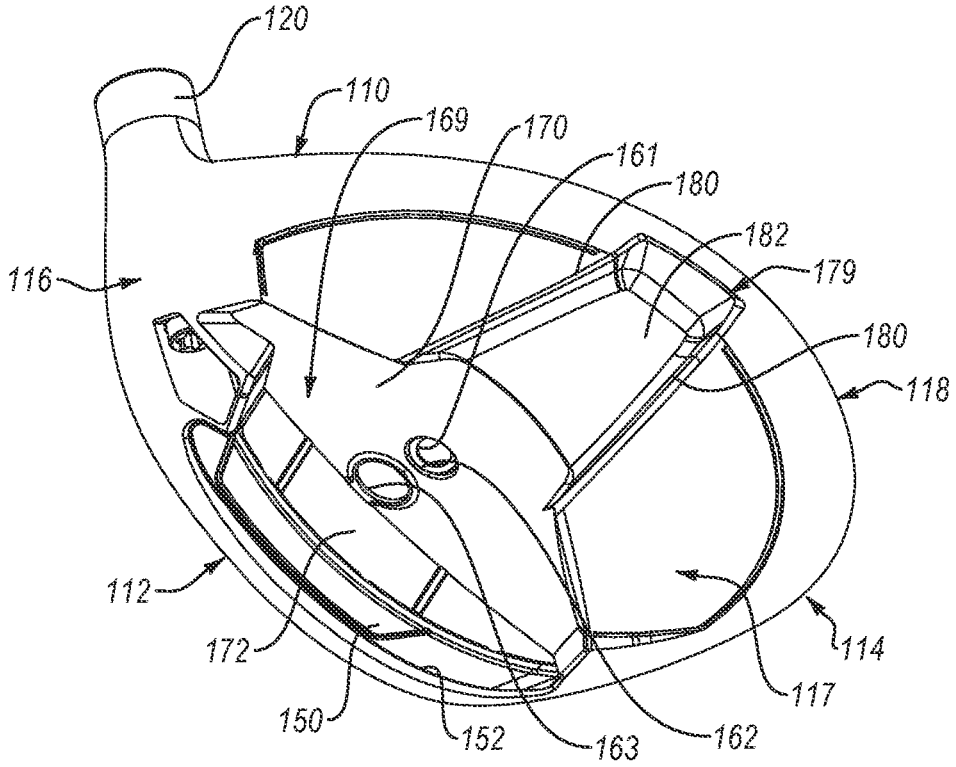
FIG. 11 is a perspective view of the golf club head of FIG. 1, from a bottom-rear of the golf club head and shown with a large weight removed, according to one or more examples of the present disclosure.
Figure 12:
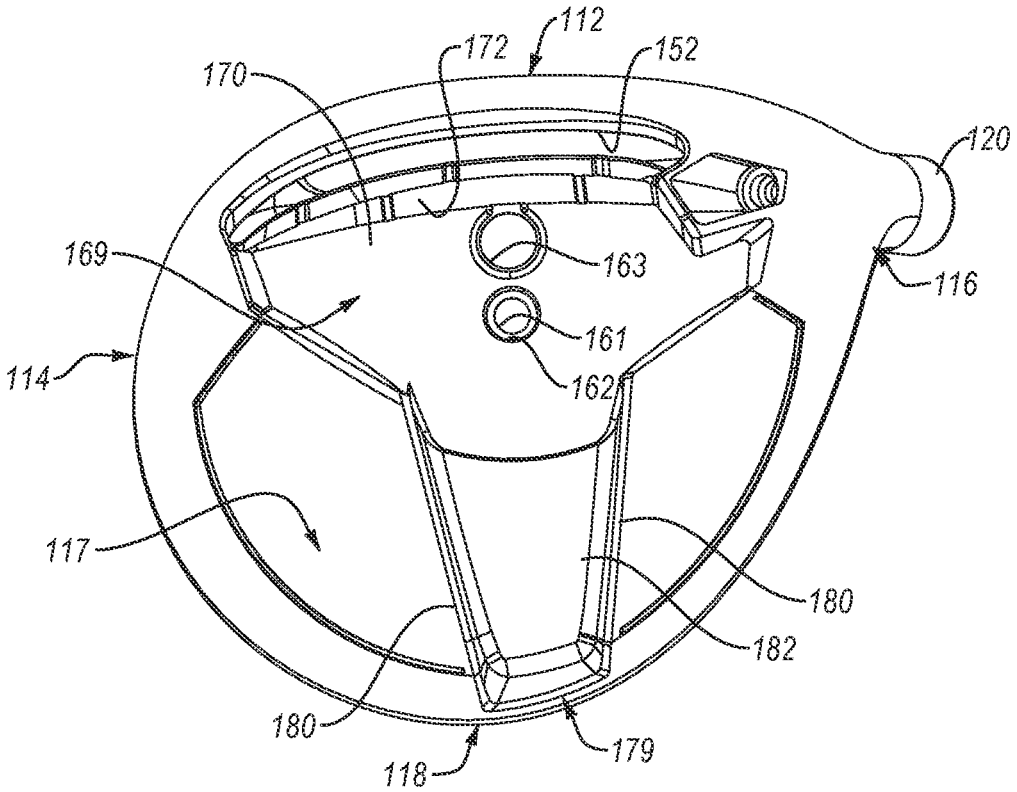
FIG. 12 is a bottom plan view of the golf club head of FIG. 1, shown with a large weight removed, according to one or more examples of the present disclosure.
Figure 13:
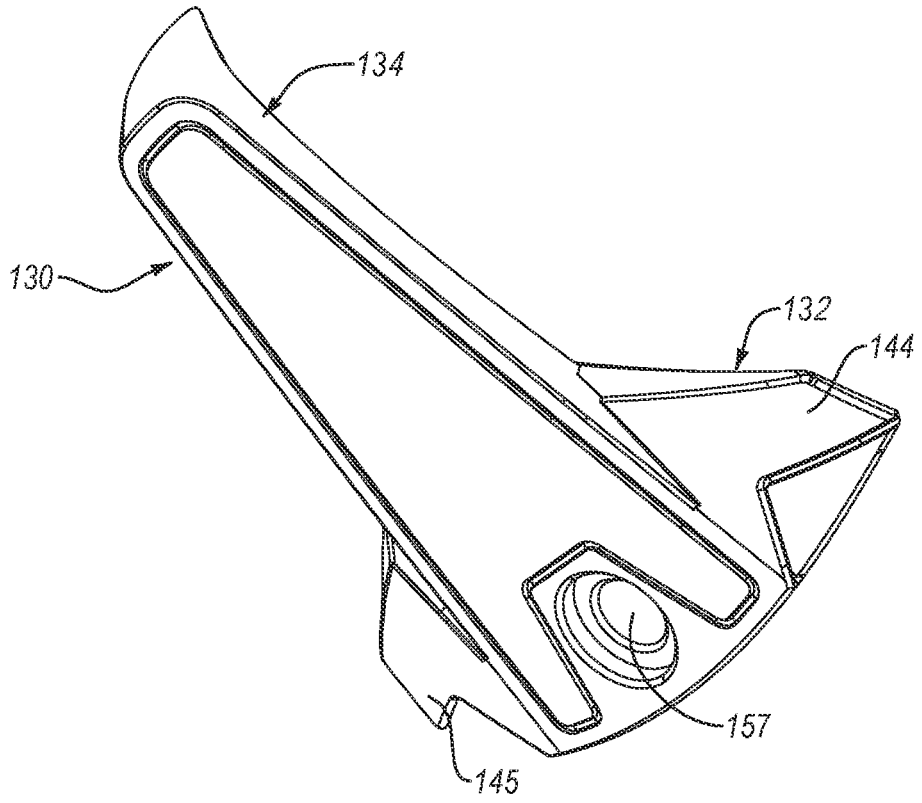
FIG. 13 is a perspective view of a large weight of the golf club head of FIG. 1, from a bottom of the large weight, according to one or more examples of the present disclosure.
Figure 14:
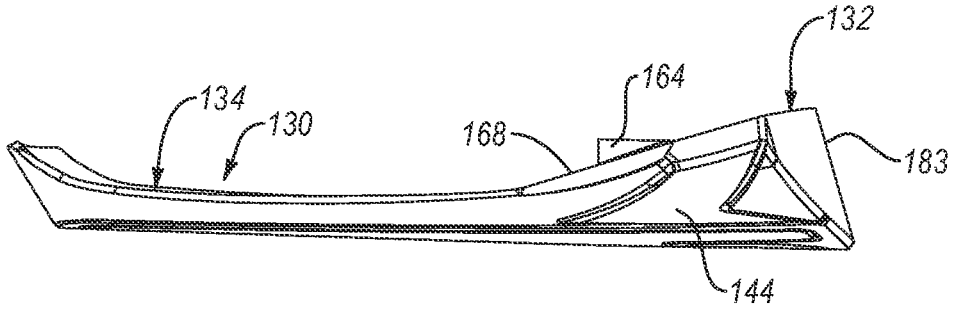
FIG. 14 is a side elevation view of the large weight of the golf club head of FIG. 1, according to one or more examples of the present disclosure.

Additionally, referring to FIGS. 8, 11, and 12, the interior boss 158 defines a weight-boss recess 162 that is coaxial with the second bolt hole 161, larger than the second bolt hole 161, and open to (e.g., facing) an exterior of the body 110. The large weight 130 includes a weight boss 164 that defines a first bolt hole 165 coaxial with the weight boss 164. The first bolt hole 165 is a counterbore or a blind hole that is open on an interior side of the large weight 130, which is a side of the large weight 130 that faces the body 110, and closed on an exterior side of the large weight 130. Moreover, the first bolt hole 165 includes internal threads configured to threadably engage the external threads of the bolt 156. The weight-boss recess 162 is configured to nestably receive the weight boss 164. Accordingly, when the large weight 130 is coupled to the sole portion 117 of the body 110, the weight boss 164 of the large weight 130 is nestably received within or nestably engages the weight-boss recess 162 of the sole portion 117 of the body 110. Nestable engagement between the weight boss 164 and the weight-boss recess 162 helps to keep the large weight 130 in place and non-movably fixed relative to the body 110 during use of the golf club head 100.

When the weight-boss recess 162 and the weight boss 164 are nestably engaged, a shaft of the bolt 156 can be passed, from within the interior cavity 160 of the body 110, through the second bolt hole 161 of the body 110 and into threadable engagement with the first bolt hole 165 of the large weight 130. Tightening the bolt 156 relative to the first bolt hole 165 of the large weight 130 tightens the large weight 130 against the exterior surface of the sole portion 117 of the body 110. The head of the bolt 156 is positioned within the interior cavity 160 as and after the bolt 156 is tightened. Moreover, as described below, the sole portion 117 of the body 110 includes weight engagement features formed in the exterior surface of the sole portion 117 that further help to keep the large weight 130 in place and non-movably fixed relative to the body 110 during use of the golf club head 100.

Referring to FIGS. 13-18, the large weight 130 includes a forward portion 132 and a rearward portion 134. When the large weight 130 is coupled to the body 110, the forward portion 132 is proximal the forward region 112 of the golf club head 100 and the rearward portion 134 extends rearwardly, along a y-axis of the golf club head origin coordinate system 185, away from the forward portion 132. More specifically, a theoretical forward-rearward midplane MP1 of the large weight 130, extending parallel to an x-axis of the golf club head origin coordinate system 185 of the golf club head 100 at a midpoint between a forwardmost point of the large weight 130 and a rearwardmost point of the large weight 130, separates the forward portion 132 from the rearward portion 134. The forward portion 132 of the large weight 130 extends from the toe region 114 to the heel region 116 when coupled to the body 110. Moreover, when coupled to the body 110, the rearward portion 134 of the large weight 130 extends from the forward region 112 to the rearward region 118. In some examples, the footprint of the large weight is substantially T-shaped.

The large weight 130 also includes a toeward portion 144 and a heelward portion 145. Generally, the toeward portion 144 is closer to the toe region 114 than the heelward portion 145, and the heelward portion 145 is closer to the heel region 116 than the toeward portion 144. More specifically, a theoretical toe-heel midplane MP4 of the large weight 130, extending parallel to the y-axis of the golf club head origin coordinate system 185 of the golf club head 100 at a midpoint between a toewardmost point of the large weight 130 and a heelwardmost point of the large weight 130, separates the toeward portion 144 from the heelward portion 145. According to some examples, the maximum heel-to-toe dimension of the large weight 130 is at least 88%, inclusive, at least 90%, inclusive, or at least 92%, inclusive, of the maximum front-to-back dimension of the large weight 130.

The large weight 130 is asymmetrical. Accordingly, the large weight 130 does not have a circular outer periphery. In some examples, the large weight 130 is asymmetrical about a YZ-plane of the golf club head 100. As used herein, the YZ-plane is a plane that is parallel to both the y-axis and the z-axis of the golf club head origin coordinate system 185. In yet some examples, the large weight 130 is asymmetrical about a XZ-plane of the golf club head 100. As used herein, the XZ-plane is a plane that is parallel to both the x-axis and the z-axis of the golf club head origin coordinate system 185.

Corresponding with the asymmetry of the large weight 130, in certain examples, the toeward portion 144 of the large weight 130 is more massive than the heelward portion 145 of the weight. Such an imbalance in the mass of the large weight 130 helps to establish a more toeward center-of-gravity of the large weight 130, and thus the golf club head 100. Also corresponding with the asymmetry of the large weight 130, the forward portion 132 of the large weight 130 is more massive than the rearward portion 134 of the large weight 130. Such an imbalance in the mass of the large weight 130 helps to establish a more forward center-of-gravity of the large weight 130, and thus the golf club head 100. In some examples, a ratio of the mass of the forward portion 132 of the large weight 130 to a mass of the rearward portion 134 of the large weight 130 is at least 1.1. In one example, the ratio of the mass of the forward portion 132 of the large weight 130 to the mass of the rearward portion 134 of the large weight 130 is at least 2.5. In yet another example, the ratio of the mass of the forward portion 132 of the large weight 130 to the mass of the rearward portion 134 of the large weight 130 is between 6 and 20, inclusive.

According to some examples, the heelward portion 145 of the forward portion 132 of the large weight 130 is less massive than the toeward portion 144 of the forward portion 132 of the large weight 130 because the heelward portion 145 includes a notch 143 that the toeward portion 144 does not have. The notch 143 is configured to accommodate the FCT component 122, which further includes a locking screw 125. The locking screw 125 engages other features of the FCT component from the sole portion 117, or from underneath the golf club head 100. The cast frame 111 of the body 110 includes a shaft attachment port 123 formed in the sole portion 117 at the heel region 116 of the golf club head 100 (see, e.g., FIG. 4). The shaft attachment port 123 has a port width WP. Generally, the shaft attachment port 123 is open to a bottom end of the hosel 120 and a hosel bore such that a passage, at the bottom end of the hosel 120, provides communication between the hosel bore and the shaft attachment port 123. The FCT component comprises a sleeve that is mounted on a tip end of the shaft 129 and is adapted to be inserted into the hosel bore. The locking screw 125 or fastener is positioned within and extends through the shaft attachment port 123 to engage the sleeve of the FCT component to lock the FCT component to the hosel 120. More specifically, the locking screw 125 includes a head portion in the shaft attachment port and a shaft portion extending through the passage. The shaft portion is selectively attachable to the sleeve when the sleeve is inserted into the hosel bore.

The notch 143 of the large weight 130 has a contour that conforms to (e.g., has the same shape as) at least part of the contour of the shaft attachment port 123. In some examples, the port width WP of the shaft attachment port 123 is greater than the width WG of the sole slot 152 where the shaft attachment port 123 and the sole slot 152 define a port-to-slot or port-to-channel junction. According to some examples, at least a portion of the large weight 130 is located within a 25 mm radius, inclusive, a 20 mm radius, inclusive, or a 15 mm radius, inclusive, of the shaft attachment port 123.

The mass distribution of the golf club head 100 corresponds with the mass distribution of the large weight 130. For example, the ratio of the mass of the golf club head 100 forward of a theoretical forward-rearward midplane MP3 of the golf club head 100 to the mass of the golf club head 100 rearward of the theoretical forward-rearward midplane MP3 of the golf club head 100 is at least 1.1. In some examples, at least 51%, inclusive, or at least 60%, inclusive, of the total mass of the large weight 130 is forward of the theoretical forward-rearward midplane MP3 of the golf club head 100. However, according to one example, at least a portion of the large weight 130 crosses the theoretical forward-rearward midplane MP3 of the golf club head 100.

As shown in FIG. 5, the theoretical forward-rearward midplane MP3 of the golf club head 100 is a theoretical plane that extends parallel to the x-axis of the golf club head origin coordinate system 185 at a midpoint between the forwardmost point of the golf club head 100 and the rearwardmost point of the golf club head 100. The distance between the forwardmost point of the golf club head 100 and the rearwardmost point of the golf club head 100 is defined as the total head length LH of the golf club head 100. In a similar matter, the distance between forwardmost point of the large weight 130 and the rearwardmost point of the large weight 130 is defined as the total weight length LW. According to certain examples, the total weight length LW is at least 50%, inclusive, of the total head length LH, at least 60%, inclusive, of the total head length LH, at least 70%, inclusive, of the total head length LH, or at least 80%, inclusive, of the total head length LH. In certain examples, as shown in FIG. 6, the golf club head 100 has a total height HH less than about 45 mm.

In some examples, the forward portion 132 of the large weight 130 is made more massive than the rearward portion 134 of the large weight 130 by varying the thickness the large weight 130 (e.g., a wall of the large weight 130). According to one example, a minimum wall thickness of the large weight (130) is between 1 mm and 3 mm, inclusive, and a maximum wall thickness of the large weight (130) is between 7 mm and 20 mm, inclusive. In particular examples, the forward portion 132 of the large weight 130 is thicker than the rearward portion 134 of the large weight 130, which helps to distribute the mass of the golf club head 100 closer to the strike face 106 and lower relative to the strike face 106. To more gradually distribute the mass of the golf club head 100 forwardly, in some examples, the thickness of the forward portion 132 steadily increases from the theoretical forward-rearward midplane MP1 of the large weight 130 forward toward the face portion 142 of the body 110. In certain examples, at least part of the forward portion 132 of the large weight 130 is between 300% and 2000% thicker than at least part of the rearward portion 134 of the large weight 130, which ensures a significant majority of the mass of the large weight 130 is closer to forward region 112 than the rearward region 118. According to some examples, at least part of the forward portion 132 of the large weight 130 is at least 400%, 600%, or 800% thicker than at least part of the rearward portion 134 of the large weight 130.

To help generate inertia during a swing of the golf club head 100 and to further lower the center-of-gravity of the golf club head 100, in certain examples, at least a portion of the large weight 130 is raised or elevated above an external surface of the sole portion 117 surrounding the at least the portion of the large weight 130. Put another way, in these examples, at least a portion of the large weight 130 protrudes downwardly away from the external surface of the sole portion 117 surrounding that portion of the large weight 130 when the golf club head 100 is in a proper address position. As used herein, the external surface of the sole portion 117 surrounding the raised portion of the large weight 130 includes the surface immediately adjacent and at least slightly spaced from the raised portion and the surface. In certain examples, at least a portion of the large weight 130 is raised above an external surface of the sole portion 117 surrounding the at least the portion of the large weight 130 by at least 1.5 mm, at least 1.8 mm, at least 2.1 mm, or at least 3.0 mm. In certain implementations, the more the large weight 130 is raised above the surrounding external surface of the sole portion 117, the greater the inertia generated by the golf club head 100 and the lower the center-of-gravity of the golf club head 100. For example, a Zup value of the golf club head 100 (e.g., the vertical distance from the ground plane to the center-of-gravity) can be between 10 mm and 20 mm. According to certain implementations, not only is a portion of the large weight 130 raised above the surrounding external surface of the sole portion 117, but in some examples, at least a portion of the large weight 130 is raised above the recess of the front weight mating feature 169 as described below.

The large weight 130 is situated relative to the body 110 of the golf club head 100 such that at least a portion of the large weight 130 is configured to contact the ground plane 199 during a normal swing of the golf club head. In one particular example, at least a portion of the large weight 130 is configured to act as a ground surface contact, such as when the large weight 130 is supported on the ground plane 199 in a proper address position. In some implementations, the portion of the large weight 130 acting as the ground surface contact also acts as the sole contact point with the ground plane 199.

Referring to FIGS. 2 and 5, the golf club head 100 includes a theoretical toe-heel midplane MP2 defined as a theoretical plane that extends parallel to a y-axis of the golf club head origin coordinate system 185 at a midpoint between a toewardmost point 131 of the golf club head 100 and a heelwardmost point 139 of the golf club head 100 (e.g., a midpoint of the total width WH of the golf club head 100). As used herein, in some examples, the heelwardmost point 139 is the most heelward point, on the outer surface of the heel region 116 of the golf club head 100, at a distance of 0.875 inches (22.23 mm) above the ground plane 199 when the golf club head 100 is supported on the ground plane 199 in the proper address position.

Generally, the large weight 130 extends from the forward region 112 of the golf club head 100 to the rearward region 118 of the golf club head 100 along the theoretical toe-heel midplane MP2. The large weight 130 also defines an exterior surface of the bottom region 193 of the golf club head 100 along the theoretical toe-heel midplane MP2. The elevation of the large weight 130 relative to the external surface of the sole portion 117 surrounding the large weight 130 can be expressed in terms of the minimum distance (i.e., second distance DH) between the large weight 130, at various points on the large weight 130, and the ground plane 199 when the golf club head is at proper address position on the ground plane 199. The points on the large weight 130 can be defined by a first distance DL of the points away from the leading edge 197 of the face portion 142. The second distances DH (in millimeters (mm)) of several points on the large weight 130, according to one or more examples, are listed in Table 1 below.

TABLE 1

| Second Distance DH (mm) | | | | | | | | |
|---|---|---|---|---|---|---|---|---|
| | % WH From Toe-Heel Midplane | | | | | | | |
| % LH | 25% Toe | 15% Toe | 10% Toe | 0% | 5% Heel | 20% Heel | 25% Heel | 30% Heel |
| 50% | 6.49 | 5.66 | 5.19 | 1.01 | 0.85 | 4.56 | 5.35 | 6.41 |
| 60% | 6.56 | 5.63 | 4.96 | 1.25 | 1.1 | 4.76 | 5.56 | 6.72 |
| 70% | 6.84 | 5.82 | 5.06 | 1.54 | 1.39 | 5.18 | 6.11 | 7.58 |

In Table 1, % LH is the percentage of the total length LH of the golf club head that the point is located away from a leading edge 197 of the face portion 142 along the theoretical toe-heel midplane MP2 and % WH is the percentage of a total width WH of the golf club head 100 away from the theoretical toe-heel midplane MP2 (either heelward or toeward) that the point is located. The total width WH of the golf club head 100 is defined as the distance between a toewardmost point 131 and a heelwardmost point 139 of the golf club head 100 (see, e.g., FIGS. 2 and 5).

The body 110 of the golf club head 100 and the large weight 130 both include mating features that help mate the large weight 130 to the body 110. The mating features are configured to promote non-movable fixation of the large weight 130 relative to the body 110 during use of the golf club head 100. As shown in FIGS. 11, 12, and 15-17, in some examples, the sole portion 117 of the body 110 includes a front weight mating feature 169 and a rear weight mating feature 179 formed into the sole portion 117. Correspondingly, in the same examples, the large weight 130 includes a front body mating feature 167 and a rear body mating feature 133 formed into the large weight 130. The front weight mating feature 169 matingly engages the front body mating feature 167 and the rear weight mating feature 179 matingly engages the rear body mating feature 133. In some examples, mating engagement includes flush contact between mating surfaces.

Referring to FIGS. 11 and 12, the front weight mating feature 169 of the body 110 includes a first flat surface 170 and a second flat surface 172 (defined by a forward wall of the golf club head 100). The forward wall also forms a rear surface of the sole slot 152.

The second flat surface 172 is angled forwardly relative to the first flat surface 170. Accordingly, in some examples, the front weight mating feature 169 includes a recess defined between the first flat surface 170 and the second flat surface 172. The recess of the front weight mating feature 169 receives at least a portion of the large weight 130 and has a depth that varies in a direction away from the face portion 142 of the body 110. According to certain examples, the depth of the recess of the front weight mating feature 169 is greater proximal the face portion 142 than distal the face portion 142. In other words, a forward wall defining the recess is greater than any rearward wall defining the recess. Moreover, according to certain examples, the depth of the recess of the front weight mating feature 169 is greater proximal the shaft attachment port 123 than distal the shaft attachment port 123. The recess of the front weight mating feature 169 shares a common wall with the shaft attachment port 123 in certain examples. In some examples, the first flat surface 170 is angled relative to a lowermost surface of the sole portion 117 by an angle ϕ (see, e.g., FIG. 8). In some implementations, the angle ϕ is an acute angle and selected such that the first flat surface 170 is perpendicular, or close to perpendicular, to the strike face 106. In contrast, the second flat surface 172 is angled relative to the first flat surface 170 such that the second flat surface 172 is parallel, or close to parallel, to the strike face 106. Such a configuration helps to locate more mass forward in the golf club head 100.

Also referring to FIGS. 11 and 12, the rear weight mating feature 179 includes a mound 182 and a groove 180 that extends along the perimeter of the mound 182 at the base of the mound 182. The mound 182 and groove 180 are shaped to complement the shape of the rearward portion 134 of the large weight 130. The mound 182 projects downwardly relative to the adjacent exterior surface of the sole portion 117 when the golf club head 100 is in the proper address position. The groove 180, in effect, outlines the mound 182 and defines a depression or recess relative to the adjacent exterior surface of the sole portion 117.

Figure 15:
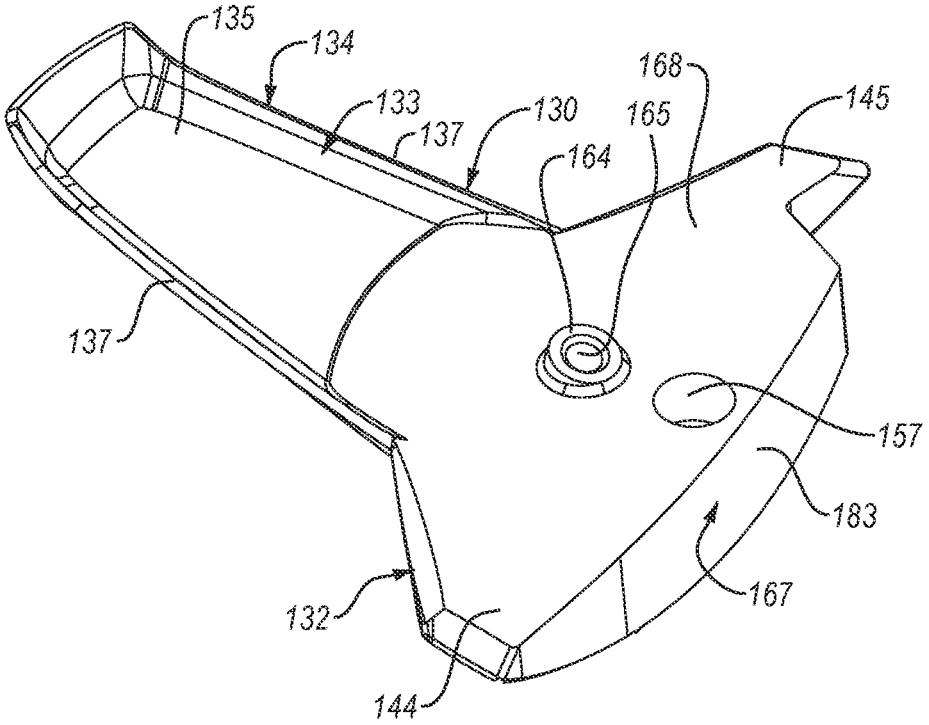
FIG. 15 is a perspective view of the large weight of the golf club head of FIG. 1, from a top-front of the large weight, according to one or more examples of the present disclosure.
Figure 16:
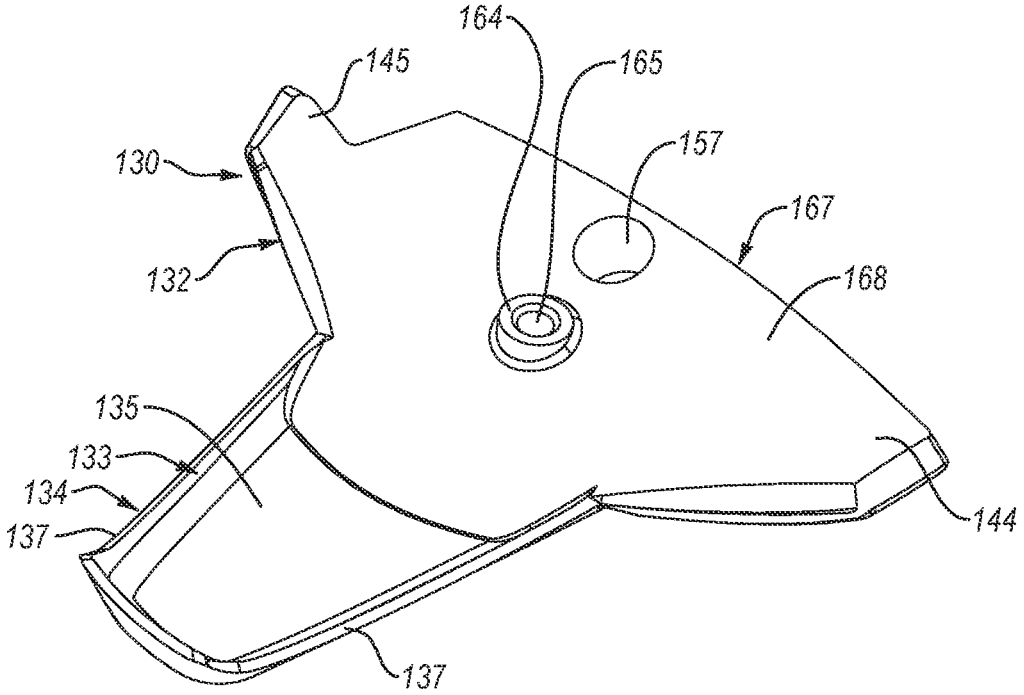
FIG. 16 is a perspective view of the large weight of the golf club head of FIG. 1, from a top-rear of the large weight, according to one or more examples of the present disclosure.
Figure 17:
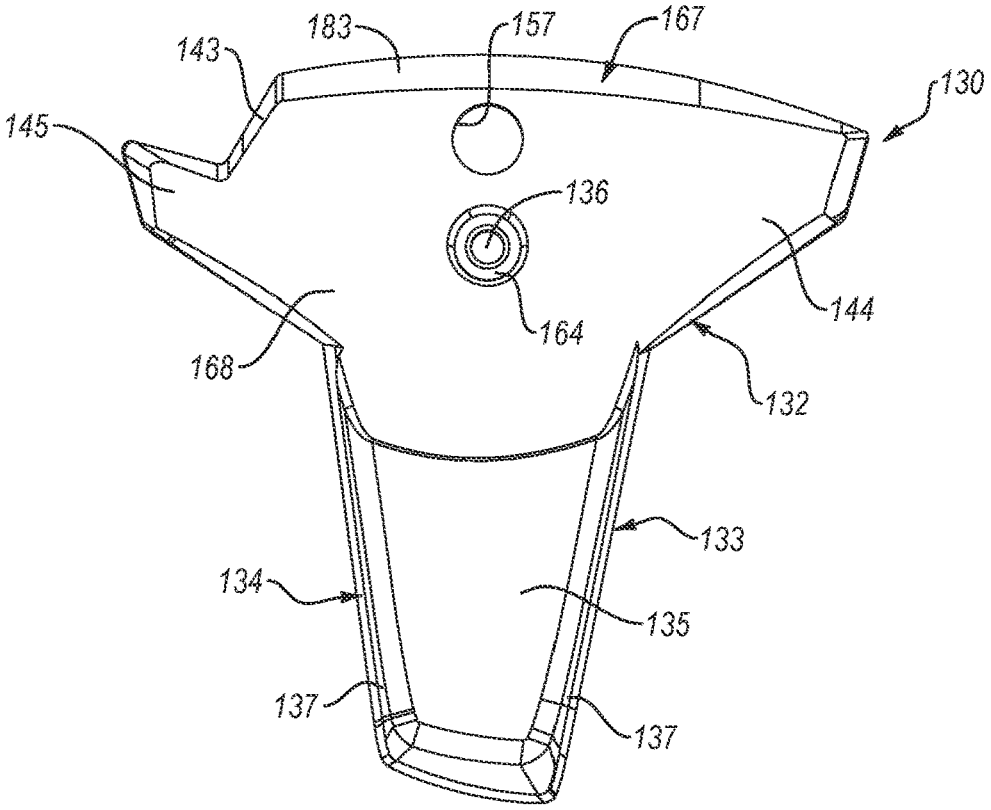
FIG. 17 is a top plan view of the large weight of the golf club head of FIG. 1, according to one or more examples of the present disclosure.
Figure 18:
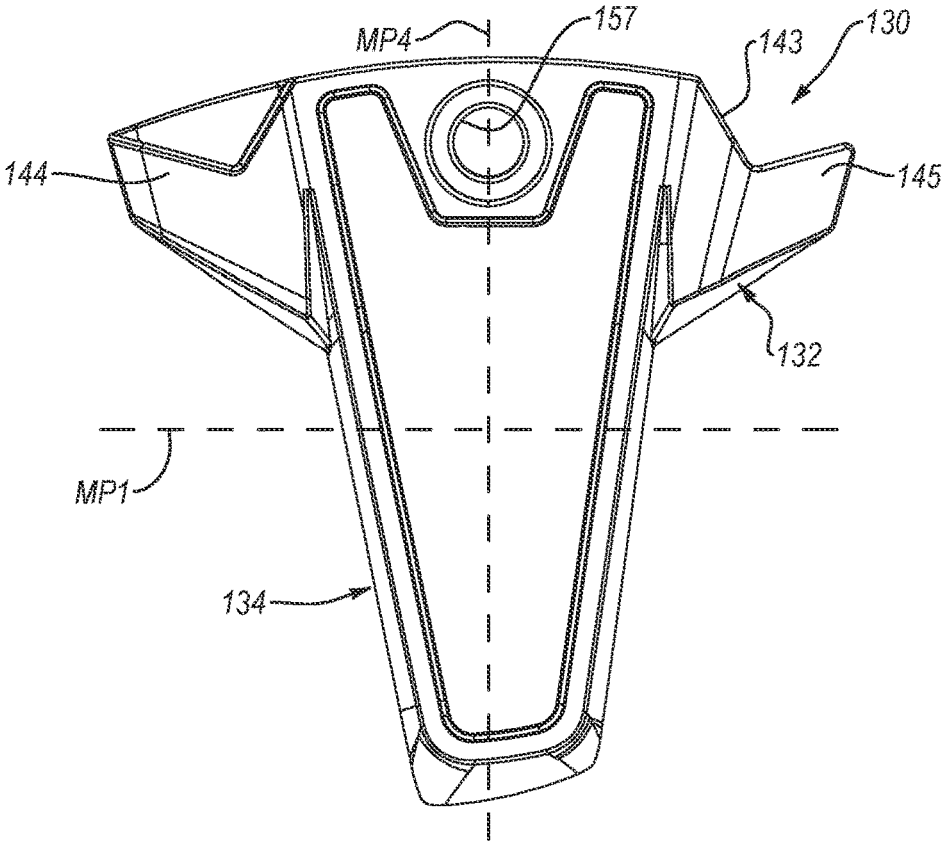
FIG. 18 is a bottom plan view of the large weight of the golf club head of FIG. 1, according to one or more examples of the present disclosure.

Referring to FIGS. 15-17, the front body mating feature 167 of the large weight 130 includes a third flat surface 168 and a fourth flat surface 183. The fourth flat surface 183 is angled forwardly relative to the third flat surface 168. Accordingly, the front body mating feature 167 is a protrusion defined between the third flat surface 168 and the fourth flat surface 183. In some examples, the first flat surface 170 is angled relative to a lowermost surface of the sole portion 117 by the angle ϕ (see, e.g., FIG. 8). In some implementations, the angle ϕ is an acute angle and selected such that, when the large weight 130 is coupled to the body 110, the third flat surface 168 is perpendicular, or close to perpendicular, to the strike face 106. In contrast, the fourth flat surface 183 is angled relative to the third flat surface 168 such that the fourth flat surface 183 is parallel, or close to parallel, to the strike face 106.

Also referring to FIGS. 15-17, the rear body mating feature 133 includes a rear recess 135 and an edge 137 that extends along the perimeter of the rear recess 135 at the top of the rear recess 135. The rear recess 135 and the edge 137 are shaped to complement the shape of the mound 182 and the groove 180, respectively, of the body 110.

The front body mating feature 167 of the large weight 130 matingly (e.g., nestably) engages the front weight mating feature 169 of the body 110 by directly interfacing the third flat surface 168 with the first flat surface 170 and directly interfacing the fourth flat surface 183 with the second flat surface 172. In this manner, the third flat surface 168 is in flush contact with the first flat surface 170 and the fourth flat surface 183 is in flush contact with the second flat surface 172. Similarly, the rear body mating feature 133 of the large weight 130 matingly (e.g., nestably) engages the rear weight mating feature 179 of the body 110 by directly interfacing the rear recess 135 with the mound 182 and directly interfacing the edge 137 with the groove 180. In this manner, the rear recess 135 is in flush contact with the mound 182 and the edge 137 is in flush contact with the groove 180.

Referring to FIGS. 3-5 and 7-9, the golf club head 100 further includes a small weight 140 coupled directly to the large weight 130. More specifically, on some examples, the small weight 140 is coupled directly to the forward portion 132 of the large weight 130. Moreover, in certain examples, the small weight 140 is forward of the second bolt hole 161 of the body 110. The small weight 140 can be aligned with the second bolt hole 161 along the y-axis of the golf club head origin coordinate system 185. As used herein, the small weight 140 is smaller than the large weight 130 because either, or both of, the small weight 140 has a smaller mass than the large weight 130 of the small weight 140 has a smaller size than the large weight 130. In the illustrated example, the small weight 140 has both a smaller mass and a smaller size compared to the large weight 130. According to some examples, the mass of the small weight is at most 15% of the mass of the large weight 130. In certain examples, the large weight 130 has a volume of at least 3 cc, inclusive, at least 9 cc, inclusive, or at least 100 cc, inclusive. The small weight 140 is non-tapered in some examples such a thickness of a shaft of the small weight 140 does not vary along its length. Likewise, in some examples, a density of the small weight 140 is the same along its length.

The small weight 140 is coupled to the large weight 130 by being at least partially embedded within the large weight 130. Moreover, the small weight 140 is releasably coupled to the large weight 130 in some examples such that the small weight 140 can be tightened to and loosened from the large weight 130. More specifically, in one example, the small weight 140 is threadably coupled to the large weight 130. The large weight 130 includes a first small-weight through-aperture 157 configured to receive the small weight 140. The hole 166 includes internal threads in some examples, which are designed to threadably engage corresponding external threads formed in the small weight 140. The first small-weight through-aperture 157 can be a through-hole that extends entirely through a thickness of the large weight 130. Moreover, in certain examples, to accommodate different lengths of the small weight 140 or to accommodate interchangeability of different small weights 140, each with a different length, the sole portion 117 of the body 110 includes a second small-weight through-aperture 163 (see, e.g., FIG. 8). The second small-weight through-aperture 163 is aligned with the first small-weight through-aperture 157, which allows the small weight 140 to extend through both the second small-weight through-aperture 163 and the first small-weight through-aperture 157 and into the interior cavity 160 of the golf club head 100. The first small-weight through-aperture 157 may be configured to allow the small weight 140 to sit flush with or recessed relative to an exterior surface of the large weight 130. For example, the first small-weight through-aperture 157 can include a counterbore to facilitate seated engagement with a head of the small weight 140.

The material of the small weight 140 can be the same as or different than the material of the large weight 130. Moreover, the density of the small weight 140 can be the same as or different than (e.g., greater than) the density of the large weight 140. In some examples, the material and the density of the small weight 140 is different than the material and the density of the large weight 130. According to one example, the small weight 140 is made of a tungsten alloy with a first density and the large weight 130 is made of a steel alloy with a second density, greater than the first density. In another example, the small weight 140 is made of a first type of steel alloy with a first density and the large weight 130 is made of a second type of steel alloy with a second density, greater than the first density.

The body 110, and more particularly the cast frame 111 of the body 110, is made of a first material having a first material density. In contrast, the large weight 130 is made of a second material having a second material density. The second material density is greater than the first material density. In other words, the large weight 130 is more dense than the body 110. According to some examples, a ratio of the second material density to the first material density is at least 1.7, inclusive. In one example, the first material is a titanium alloy, such as any one of the titanium alloys disclosed above. However, in other examples, the first material is a steel alloy, a plastic, or an aluminum alloy. The second material is a steel alloy in some examples and a tungsten alloy in other examples.

Relative to conventional golf club heads, the large weight 130 has a greater mass compared to the mass of the rest of the golf club head 100. For example, according to one example, the mass of the large weight 130 is at least 23%, inclusive, at least 40%, inclusive, at least 45%, inclusive, at least 50%, inclusive, at least 55%, inclusive, at least 60%, inclusive, at least 65%, inclusive, at least 70%, inclusive, 75%, inclusive, or 100%, inclusive, of the mass of the cast frame 111. When used for purposes of mass calculations and mass comparisons with the large weight 130, the cast frame 111 includes all portions of the body 110 made of a titanium alloy, including the strike plate 107, if made of a titanium alloy, even though the strike plate is not co-cast with the cast frame 111. In such an example, the total or combined mass of the large weight 130 and the cast frame 111 is at least 210 grams. According to one example, the total mass of the golf club head 100 is greater than 212 grams, inclusive.

In some specific examples, the mass of the large weight 130 is at least 75 grams, inclusive, and the mass of the cast frame 111 is at least 75 grams, inclusive. According to one example, the mass of the large weight 130 is at least 90 grams, inclusive, and the mass of the cast frame 111 is at least 90 grams, inclusive. In another examples, the mass of the large weight 130 is at least 100 grams, inclusive, and the mass of the cast frame 111 is at least 100 grams, inclusive The collective features of the golf club head 100 described above help to improve the performance characteristics of the golf club head 100. In one example, a balance point projection of the golf club head 100 is below a geometric center of the strike face 106, which can be defined as the center face of the strike face, when the golf club head 100 is in proper address position. According to another example, the characteristic time (CT) at the geometric center is less than 257 microseconds and more than 237 microseconds. According to various examples, the CT of the golf club head can be tuned in accordance with the disclosure found in U.S. Pat. No. 10,188,915, issued Jan. 29, 2019; U.S. patent application Ser. No. 16/167,078, filed Oct. 22, 2018; and U.S. patent application Ser. No. 16/223,108, filed Dec. 17, 2018, which are incorporated herein by reference in their entirety.

Although not specifically shown, the golf club head 100 of the present disclosure may include other features to promote the performance characteristics of the golf club head 100. For example, the golf club head 100, in some implementations, includes movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426, the entire contents of each of which are incorporated herein by reference in their entirety.

In certain implementations, for example, the golf club head 100 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

According to some implementations, the golf club head 100 includes aerodynamic shape features similar to those described in more detail in U.S. Patent Application Publication No. 2013/0123040A1, the entire contents of which are incorporated herein by reference in their entirety.

In certain implementations, the golf club head 100 includes removable shaft features similar to those described in more detail in U.S. Pat. No. 8,303,431, the contents of which are incorporated by reference herein in in their entirety.

According to yet some implementations, the golf club head 100 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 100 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some examples, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A golf club, comprising:

a golf club shaft comprising a butt end and a tip end;

a golf club head comprising a body, defining an interior cavity of the golf club head, and further comprising a sole defining a bottom portion of the golf club head, a crown defining a top portion of the golf club head, a skirt portion defining a periphery of the golf club head between the sole and the crown, a face defining a forward portion of the golf club head, and a hosel defining a hosel bore, wherein the body further comprises a shaft attachment port positioned in the sole and extending into the interior cavity, the shaft attachment port having a port width, the shaft attachment port being located proximate a bottom end of the hosel such that a passage in the bottom end of the hosel provides communication between the hosel bore and the shaft attachment port;

a sleeve mounted on the tip end of the golf club shaft and adapted to be inserted into the hosel bore; and a fastener having a head portion and a shaft portion, wherein the shaft portion of the fastener extends through the passage, the fastener being selectively attachable to the sleeve when the sleeve is inserted into the hosel bore, wherein:

the golf club head further comprises a large weight, attached to the body, wherein the body is made of at least a first material having a first material density of no more than 8 g/cc, the large weight is made of a second material having a second material density of no less than 7 g/cc, and the first material density is less than the second material density;

a ratio of the second material density to the first material density is at least 1.70, inclusive;

at least 60%, inclusive, of a total mass of the large weight is forward of a theoretical forward-rearward midplane of the golf club head that extends parallel to an x-axis of a golf club head origin coordinate system of the golf club head at a midpoint between a forwardmost point of the golf club head and a rearwardmost point of the golf club head;

the body comprises a weight mating recess, configured to receive at least a portion of the large weight;

the large weight has a thickness that varies;

the large weight has a volume of at least 3 cubic centimeters, inclusive;

the large weight defines a portion of a sole of the golf club head; and the large weight defines at least 6 square centimeters of a surface area of the sole.

2. The golf club according to claim 1, wherein at least a portion of the large weight is located within a 25 mm radius of the shaft attachment port.

3. The golf club according to claim 1, wherein the large weight has a thickness that varies.

4. The golf club according to claim 1, wherein:

the first material comprises at least one of a plastic, aluminum alloy, titanium alloy, or a steel alloy;

the second material comprises one of a steel alloy or a tungsten alloy; and the crown portion of the body is at least partially made of a fiber-reinforced polymer having a density between 1 gram/cc (g/cc) and 2 g/cc, inclusive.

5. A golf club head, comprising:

a body, comprising a face portion and defining an interior cavity and a hosel defining a hosel bore; and a large weight, attached to the body, wherein the body is made of at least a first material having a first material density of no more than 8 g/cc, the large weight is made of a second material having a second material density of no less than 7 g/cc, and the first material density is less than the second material density;

wherein:

a ratio of the second material density to the first material density is at least 1.70, inclusive;

at least 60%, inclusive, of a total mass of the large weight is forward of a theoretical forward-rearward midplane of the golf club head that extends parallel to an x-axis of a golf club head origin coordinate system of the golf club head at a midpoint between a forwardmost point of the golf club head and a rearwardmost point of the golf club head;

the body comprises a weight mating recess, configured to receive at least a portion of the large weight;

the large weight has a volume of at least 3 cubic centimeters, inclusive;

the large weight defines a portion of a sole of the golf club head; and the large weight defines at least 6 square centimeters of a surface area of the sole.

6. The golf club head according to claim 5, wherein the large weight has a thickness that varies.

7. The golf club head according to claim 5, wherein:

the first material is one of a plastic, aluminum alloy, titanium alloy or a steel alloy;

the second material is one of a steel alloy or a tungsten alloy; and a crown portion of the body is at least partially made of a fiber-reinforced polymer having a density between 1 gram/cc (g/cc) and 2 g/cc, inclusive.

8. The golf club head according to claim 5, wherein a mass of the large weight is at least 40% of a mass of the portion of the body made of the first material.

9. The golf club head according to claim 5, wherein the large weight is fixed to the body by at least one of an adhesive and a fastener.

10. The golf club head according to claim 5, further comprising an adjustable lie/loft assembly coupled to the body.

11. The golf club head according to claim 5, wherein the body further comprises a shaft attachment port positioned in the sole and extending into the interior cavity, the shaft attachment port having a port width, the shaft attachment port being located proximate a bottom end of the hosel such that a passage in the bottom end of the hosel provides communication between the hosel bore and the shaft attachment port.

12. The golf club head according to claim 11, wherein at least a portion of the large weight is located within a 25 mm radius of the shaft attachment port.

13. The golf club head according to claim 5, wherein:

the first material is one of a plastic, aluminum alloy, titanium alloy or a steel alloy;

the second material is one of a steel alloy or a tungsten alloy;

a crown portion of the body is at least partially made of a fiber-reinforced polymer having a density between 1 gram/cc (g/cc) and 2 g/cc, inclusive; and the face portion of the body is at least partially made of a fiber-reinforced polymer having a density between 1 g/cc and 2 g/cc, inclusive.

14. The golf club head according to claim 5, wherein:

at least a portion of the body toeward of the large weight is formed of a material that has a density that is lower than the second material density of the large weight; and at least a portion of the body heelward of the large weight is formed of a material that has a density that is lower than the second material density of the large weight.

15. The golf club according to claim 5, wherein the large weight is non-circular.

16. The golf club according to claim 5, wherein the large weight is bonded to the body via an adhesive.

17. A golf club head, comprising:

a crown portion, positioned at a top region of the golf club head, a sole portion, positioned at a bottom region of the golf club head, a skirt portion, positioned around a periphery of the golf club head between the sole portion and the crown portion, and a face portion, positioned at a forward region of the golf club head, opposite a rearward region of the golf club head, and extending from a toe region to a heel region of the golf club head and defining an interior cavity and a hosel defining a hosel bore, wherein:

the golf club head is made of at least a first material having a first material density of no more than 8 g/cc, and made of a second material having a second material density of no less than 7 g/cc, and the first material density is less than the second material density;

the crown portion and the face portion are at least partially made of a third material, different than the first and second materials;

the third material is a fiber-reinforced polymer having a density between 1 gram/cc (g/cc) and 2 g/cc, inclusive; and a mass of the golf club head made of the second material is at least 40% of the mass of the golf club head made of the first material.

18. The golf club head according to claim 17, wherein:

the golf club head comprises a large weight made of the second material density, at least a portion of the golf club head toeward of the large weight is formed of a material that has a density that is lower than the second material density of the large weight; and at least a portion of the golf club head heelward of the large weight is formed of a material that has a density that is lower than the second material density of the large weight.

19. The golf club head according to claim 17, wherein:

at least a portion of the sole portion comprises a toeward edge, extending to a first rearwardmost point of the sole, and a heelward edge, extending to a second rearwardmost point of the sole;

the toeward edge is substantially linear and the heelward edge is substantially linear; and a first hypothetical line, collinear with the toeward edge, converges with a second hypothetical line, collinear with the heelward edge, at a location rearward of a rearwardmost point of the golf club head.

20. The golf club according to claim 18, wherein:

the golf club head further comprises a slot formed in the sole portion and a large weight made of the second material density;

the slot has a length, defined in a heel-to-toe direction;

the large weight has a width, defined in the heel-to-toe direction; and the width of the large weight is greater than the length of the slot.

21. The golf club according to claim 18, wherein at least a portion of the golf club head comprises aluminum and a mass percentage of aluminum in the body is less than 7%.

* * * * *